US005328815A

United States Patent [19]

Hayashi

[11] Patent Number: 5,328,815

[45] Date of Patent: Jul. 12, 1994

[54] METHOD OF PROCESSING SILVER HALIDE COLOR PHOTOGRAPHIC MATERIALS

[75] Inventor: Hiroshi Hayashi, Kanagawa, Japan

[73] Assignee: Fuji Photo Film Co., Ltd., Kanagawa, Japan

[21] Appl. No.: 47,049

[22] Filed: Apr. 12, 1993

Related U.S. Application Data

[63] Continuation of Ser. No. 642,953, Jan. 18, 1991, abandoned.

[30] Foreign Application Priority Data

Jan. 19, 1990 [JP] Japan ..... 2-8495

[51] Int. Cl.[5] ..... G03C 11/00

[52] U.S. Cl. ..... 430/463; 430/372; 430/376; 430/383; 430/427; 430/963

[58] Field of Search ..... 430/372, 376, 383, 391, 430/428, 434, 463, 539, 567, 640, 642, 963, 427

[56] References Cited

U.S. PATENT DOCUMENTS

| | | | |
|---|---|---|---|
| 4,451,132 | 5/1984 | Kishimoto | 430/398 |
| 4,797,349 | 1/1989 | Takahashi et al. | 430/372 |
| 4,830,948 | 5/1989 | Ishikawa et al. | 430/642 |
| 5,001,041 | 3/1991 | Kishimoto et al. | 430/372 |
| 5,015,563 | 5/1991 | Ohya et al. | 430/567 |
| 5,024,932 | 6/1991 | Tanji et al. | 430/642 |
| 5,055,381 | 10/1991 | Abe et al. | 430/372 |
| 5,063,139 | 11/1991 | Hayashi | 430/642 |
| 5,180,656 | 1/1993 | Kobayashi et al. | 430/963 |
| 5,206,119 | 4/1993 | Kuse et al. | 430/963 |

FOREIGN PATENT DOCUMENTS

| | | |
|---|---|---|
| 0276319 | 8/1988 | European Pat. Off. . |
| 0280238 | 8/1988 | European Pat. Off. . |
| 0407979 | 1/1991 | European Pat. Off. . |

*Primary Examiner*—Hoa Van Le

*Attorney, Agent, or Firm*—Sughrue, Mion, Zinn, Macpeak & Seas

[57] ABSTRACT

A method of processing a silver halide color photographic material comprising the steps of: (1) developing a silver halide color photographic material having an alkali consumption of 3.0 mmol/m$^2$ or less, the silver halide color photographic material comprising (a) a support; (b) at least two layers on at least one side of the support, the at least two layers containing (i) silver halide emulsions being sensitive to different wavelength bands from one another, the silver halide emulsions containing at least 90 mol % silver chloride and (ii) oil soluble couplers that form dyes on coupling with oxidized primary amine color developing agent; and (2) washing the color photographic material for about 45 seconds where water from the washing step is treated with a reverse osmosis membrane and reused in the washing step.

11 Claims, 1 Drawing Sheet

METHOD OF PROCESSING SILVER HALIDE COLOR PHOTOGRAPHIC MATERIALS

This is a Continuation of application Ser. No. 07/642,953 filed Jan. 18, 1993, now abandoned.

FIELD OF THE INVENTION

This invention concerns a method of processing silver halide color photographic materials and, more precisely, it concerns a method of processing photographic materials which can be processed using overall ultra-rapid processing.

BACKGROUND OF THE INVENTION

In recent years a demand for shorter processing times has arisen in connection with photographic processing of color photographic materials in view of decreasing finishing delivery times and down-sizing of laboratory operation. Increasing temperatures and increasing replenishment rates are general methods of reducing the time required for each processing operation, but a number of other methods, such as enforced agitation and the addition of various accelerators, for example, have also been suggested.

For example, international patent WO87-04534 discloses a color photographic material which contains emulsions having a high silver chloride content (instead of the silver bromide based or silver iodide emulsions which were widely used in the past) processed with a view to increasing the rate of color development and/or reducing the replenishment rate.

By using high silver chloride emulsions and such development processing baths it has been possible to shorten the development time from 3 minutes 30 seconds for a conventional silver bromide emulsion based material (for example, color process CP-20, produced by Fuji Photo Film Co. Ltd.) to 45 seconds (for example, color process CP-40FAS, produced by Fuji Photo Film Co. Ltd. with an overall processing time of 4 minutes). But even this is not satisfactory compared to the overall processing times of other color systems (for example with the electrostatic copying systems, thermal transfer systems, and ink-jet systems).

Consequently, development of a method of processing silver halide color photographic materials which enables ultra-rapid processing using a color development process that requires no more than 20 seconds using a silver halide color development system and produces high quality color prints inexpensively and with a considerably shortened overall processing time was desirable.

A method in which the color development processing time is reduced to not more than 25 seconds, and in which, the overall processing time, including the color development processing time, the bleach-fix processing time, and the water washing time is reduced to not more than 2 minutes by processing high silver chloride emulsions in color developers which are essentially benzyl alcohol free is disclosed in JP-A-1-196044. (The term "JP-A" as used herein signifies an "unexamined published Japanese patent application".)

However, when overall rapid processing is achieved by simply shortening the development process in this way, there is no inhibition of an increase in staining when this technique is used alone. There are also considerable practical problems with staining of the white base material. It has been concluded that this staining arises because of the increased residual amount of excess colored material (dyes etc.) in the photographic material which result from shortening the development processing time and because of inadequate washing-out of these residual materials due to the shortened processing time following development. Such staining is especially pronounced in the case of processes of the type where the replenishment rates are low.

Techniques for preventing the occurrence of staining in which the processing liquids in the water washing and/or stabilization processes are subjected to a reverse osmosis treatment are known, and such techniques have been disclosed, for example, in JP-A-60-241053 and JP-A-62-254151. The unwanted components (especially fixer and bleach-fixer components) in the water washing water and/or stabilizer are removed by subjecting the processing liquids to reverse osmosis and it is thought that this reduces the adverse effects of these components on the photographic material.

However, with processing in which the water washing time is shortened, and especially in the case of overall ultra-rapid processing from color development through to drying, as described above, it is still not possible to obtain satisfactory photographic characteristics by just using a reverse osmosis treatment technique. Thus, the problem of base staining has not been satisfactorily overcome.

SUMMARY OF THE INVENTION

Hence, a first object of this invention is to provide a method of processing silver halide color photographic materials by which satisfactory photographic performance (and especially the prevention of staining) can be obtained even with a shortened water washing time, and especially with overall ultra-rapid processing as described above.

A second object of the invention is to provide a method of processing silver halide color photographic materials by which satisfactory photographic performance can be obtained even though processing is carried out with a low replenishment rate of the water washing water.

Moreover, this invention enables the apparatus cost to be reduced and the apparatus to run more quietly; and it can be used in intelligent hard copy applications.

These and other objects can be realized by a method of processing a silver halide color photographic material comprising the steps of:

(1) developing an image-wise exposed silver halide color photographic material having an alkali consumption of 3.0 mmol/m$^2$ or less, this silver halide color photographic material comprising (a) a support;

(b) at least two layers on at least one side of the support, the at least two layers containing (i) silver halide emulsions being sensitive to different wavelength bands from one another, with the silver halide emulsions containing at least 90 mol % silver chloride and (ii) oil soluble couplers that form dyes on coupling with oxidized primary amine color developing agent; and (2) washing the color photographic material within 45 seconds where water from the washing step is treated with a reverse osmosis membrane and reused in the washing step.

The objects of the invention are also realized by a method of processing a silver halide color photographic material as described, above, wherein the developing time is within 20 seconds and the total time for processing up to completion of a drying step is within 100 seconds.

Further, the objects of the invention can be realized by a method of processing silver halide color photographic material as described above, wherein water used in the washing step is replenished at a rate of 150 ml/m$^2$ or less of photographic material; and the ratio of (water permeating through the reverse osmosis membrane per unit of time)/(water washing water replenishment rate per unit of time) is from 5 to 55.

Figure 1:
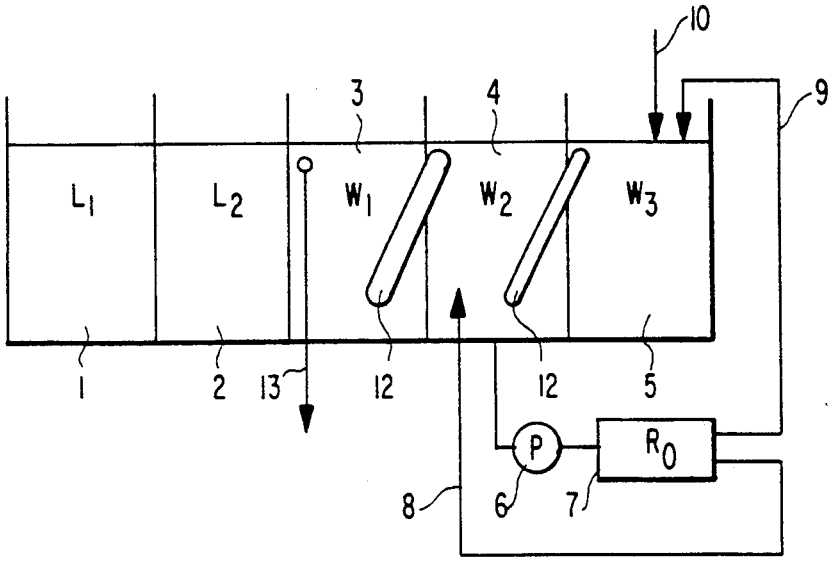
FIGS. 1 and 2 are schematic drawings of automatic processors in which a reverse osmosis apparatus is incorporated. The significance of the reference numerals used in FIGS. 1 and 2 is indicated below.

1: Color developer tank $L_1$
2: Bleach-fix tank $L_2$
3: First water washing tank $W_1$
4: Second water washing tank $W_2$
5: Third water washing tank $W_3$
6: Liquid feed pumps P, $P_1$, $P_2$
7: Pressure resistant vessel housing the reverse osmosis membrane $R_0$
8: Concentration C, $C_1$, $C_2$
9: Permeated liquid D
10: Fresh water replenishment R
11: Stock tank $S_f$
12: Counter-flow water washing water pipe work
13: Overflow water OF

DETAILED DESCRIPTION OF THE INVENTION

Thus, it has been discovered that, when subjecting photographic materials which have emulsions having a high silver chloride content to rapid processing, an adequate anti-staining effect can be obtained, surprisingly, when the water washing is reduced to within 45 seconds. Particular improvement results from using ultra-rapid processing such that the color development time is within 20 seconds and the total time from the color development process to the completion of drying is within 100 seconds; by setting the "alkali consumption" of the photographic material to not more than 3.0 mmol/m$^2$; and by recycling the wash water using a reverse osmosis membrane.

Moreover, satisfactory photographic performance can be obtained even when the replenishment rate of the wash water is not more than 150 ml, and preferably not more than 60 ml, per square meter of photographic material when, in particular, the ratio of the amount of water passing through the reverse osmosis membrane per unit of time (ml/min) to the replenishment rate of the wash water (ml/min) is preferably from 5 to 55, and most desirably from 10 to 30.

In this invention, the term "water washing process" includes so-called stabilization processes in which processing is carried out in a stabilizer which contains a chelating agent.

Furthermore, "treating the wash water with a reverse osmosis membrane" signifies that the water in at least one of the tanks which make up the water washing process is brought into contact with a reverse osmosis membrane and the water which passes through the reverse osmosis membrane (referred to hereinafter as permeated water) is returned to at least one of these tanks.

In this invention, the "alkali consumption" of the photographic material is calculated according to the method described below.

Calculating the "alkali consumption" involves first taking a sample of a fixed area (in practice 1 m$^2$) of the photographic material of this invention and peeling the coated layer away from the support. The support generally consists of a polyethylene laminated paper and the peeling is achieved at the laminated polyethylene layer. Next, the coated layer is finely ground and dispersed in a fixed quantity of water (in practice, in 100 ml of water). Next, this liquid is titrated with an aqueous alkaline solution (in practice, with 0.1N aqueous potassium hydroxide solution) and the amount of potassium hydroxide, in mmol units, required to change the pH of the liquid from 6.0 to 10.0 is defined as the "alkali consumption".

Acid components are included in the support. In those cases where separation from the support is impossible, the alkali consumption can be calculated by subtracting the measured value for the support alone from the value for the unseparated material.

Alkali consumption is an evaluation of the acid components which are contained in the photographic material and their pH buffering capacity. In practice they are affected by the gelatin used as a hydrophilic binder and the other organic compounds in the photographic material.

In this invention, initial development is retarded if the alkali consumption is high because it is impossible to maintain the high alkalinity in the initial stages of development processing and it is not possible to shorten the development processing time. It is thought that this also has an effect on the occurrence of staining in cases where the water washing time is shortened; overall ultra-rapid processing is carried out; and the unexpected results are achieved by the conjoint use of such treatments with a reverse osmosis membrane as described above.

The methods indicated below are preferred for reducing "alkali consumption" which is one of the distinguishing features of the present invention.

Firstly, the amount of hydrophilic colloid which has acidic groups in the light-sensitive material layers is reduced.

The use of gelatin as the hydrophilic colloid of a color photographic material in which a silver halide emulsion is used as the photo-sensor is most desirable. However, gelatin has a pH buffering capacity on immersion in alkaline solutions because of its functional groups.

The lowering of this buffering capacity is important for speeding up the initial development in rapid processing, and methods in which the amount of gelatin is reduced are desirable.

Secondly, there is a possibility that the physical properties of the film will be adversely affected by simply reducing the amount of gelatin and so hydrophilic polymers which do not have acidic functional groups are used conjointly.

Those mentioned as examples in this specification can be cited as hydrophilic polymers which can be used in this invention, but the use of polyacrylamide, polydextran and poly(vinyl alcohol), for example, are especially desirable.

Thirdly, the type of gelatin which is used for the hydrophilic colloid is modified.

In practical terms, the alkali consumption can be suppressed by using gelatins that have been treated differently during manufacture or that have been esterified or converted to amides to reduce the number of acidic groups and change the number of functional groups and the isoelectric point.

Fourthly, the amounts of organic materials other than gelatin (for example, couplers, hydroquinone, and phenolic compounds) which are used are reduced. If a film hardening agent is used conjointly with these means then it is possible to form a photographic material in which the initial swelling rate is more rapid.

Fifthly, alkali consumption can be reduced by adjusting the pKa value of the organic compounds referred to above.

It is necessary to suppress the "alkali consumption" of a photographic material which is in accordance with this invention in the ways described above such that it is not more than 3.0 mmol/$m^2$, but it is preferably not more than 2.8 mmol/$m^2$, more desirably not more than 2.6 mmol/$m^2$, and most desirably not more than 1.9 mmol/$m^2$.

The color photographic material of this invention can be constructed by coating at least one blue-sensitive silver halide emulsion layer, at least one green-sensitive silver halide emulsion layer and at least one red-sensitive silver halide emulsion layer on a support. In general, the layers are established in the order indicated above when the support is a color printing paper, but the layers may be established in a different order.

The image forming system including the photographic material and processing used in this invention can also be used for rapid processing of color prints; and in applications such as intelligent color hard copy where more rapid processing is more desirable.

In particular, embodiments where the photographic material has been subjected to a scanning exposure with a high density light source such as a laser (such as a semiconductor laser) are especially desirable embodiments of intelligent color hard copy.

Many semiconductor lasers produce a large percentage of energy in the infrared region. Thus, the photographic materials used may have at least one of the aforementioned emulsion layers replaced by an infrared sensitive silver halide emulsion layer.

Color reproduction with the subtractive method can be achieved by including silver halide emulsions which are sensitive to the respective wavelength regions such as blue light, green light, red light, and infrared light and color couplers which form dyes which are complimentary to the color of the actinic light. That is, yellow dyes for the blue, magenta dyes for the green, and cyan dyes for the red sensitive layers, in such light-sensitive emulsion layers. However, the structure of the material may be such that the colors of the light-sensitive layer and the coupler do not have this kind of relationship.

Moreover, depending on the image quality and product quality required, just two color couplers can be used. In such a case the silver halide emulsion layer may be comprised of two layers, one corresponding to each color. The resulting image is not a full color image, but it can be formed more rapidly.

The use of essentially silver iodide free silver chlorobromide or silver chloride for the silver halide emulsions which are used in the present invention is preferred. Here, the term "essentially silver iodide free" signifies that the silver iodide content is not more than 1 mol.%, and preferably not more than 0.2 mol.%. The halogen composition of the emulsion may differ from grain to grain, or it may be uniform, but it is easier to make the nature of the grains homogeneous when emulsions in which the halogen composition is uniform from grain to grain are used. Furthermore, the silver halide composition distribution within the silver halide emulsion grains may be such as to provide grains which have a so-called uniform structure in which the composition is uniform throughout the grains, grains which have a so-called layer type structure in which the halogen composition in the core which forms the interior of the silver halide grains and in the surrounding shell part of the grains (the shell may be a single layer or a plurality of layers) is different; or grains which have a structure in which there are parts which have a different halogen composition in a non-layer like form within the grains or on the surfaces of the grains (structures such that parts which have a different halogen composition are joined onto the edges, corners or surfaces of the grains where the parts which have a different composition are at the surface of the grains). Grains which have the appropriate structure can be selected for use.

The use of grains of either of the latter two types is preferable to the use of grains which have a uniform structure for obtaining a high photographic speed, and it is also preferred from the point of view of pressure resisting properties. In those cases where the silver halide grains have a structure such as those indicated above, the boundary region between the parts which have different halogen compositions may be a distinct boundary, or it may be an indistinct boundary where a mixed crystal is formed by the difference in composition; or it may be such that there is a positive and continuous change in the structure.

Silver chlorobromides which have any silver bromide/silver chloride ratio can be used. A wide range of composition ratios can be accommodated, depending on the intended purpose of the material, but the use of emulsions which have a silver chloride content of at least 2 mol.% is preferred.

Furthermore, the use of so-called high silver chloride emulsions which have a high silver chloride content is preferred in photographic materials which are suited to rapid processing. The silver chloride content of these high silver chloride emulsions is preferably at least 90 mol.%, and most desirably at least 95 mol.%.

The silver halide grains in the high silver chloride emulsion preferably have a localized silver bromide layer(s) or areas (hereinafter inclusively referred to as a localized phase(s)) in the inside and/or on the surface of the individual grains. The localized phase preferably has a silver bromide content of at least 10 mol %, and more preferably more than 20 mol %. These localized phases may be present in the inside of the grains or on the surface (e.g., edges, corners, or planes) of the grains. One preferred example is an epitaxially grown area on the corner(s) of grains.

On the other hand, for the purpose of minimizing reduction in sensitivity on application of pressure to a light-sensitive material, a high silver chloride emulsion having a silver chloride content of 90 mol % or higher with its halogen composition being distributed in a narrow range throughout the individual grains is also preferably used.

The silver chloride content of the silver halide emulsions can be further increased to reduce the rate of replenishing the developing solution. In this case, an emulsion comprising nearly pure silver chloride having a silver chloride content of from 98 to 100 mol % is preferably used.

The silver halide grains in the silver halide emulsions preferably have a mean grain size of from 0.1 to 2 μm (the mean grain size is the number average of the diameter of a circle equivalent to the projected area of a grain).

The emulsion is preferably a mono-dispersion in which the grain size distribution has a coefficient of variation (obtained by dividing the standard deviation by the mean grain size) is not more than 20%, and preferably not more than 15%. Two or more kinds of mono-dispersed emulsions may be blended and coated in the same layer or may be separately coated in different layers to obtain a broad tolerance.

The silver halide grains of the photographic emulsions may have a regular crystal form, such as a cubic form, a tetradecahedral form, and an octahedral form; an irregular crystal form, such as a spherical form and a plate form; or a composite crystal form thereof. The grains may be a mixture of various crystal forms. In the present invention., the grains preferably comprise at least 50%, preferably at least 70%, and more preferably at least 90%, of those having a regular crystal form.

In addition, emulsions containing tabular grains having an average aspect ratio (circle-equivalent diameter/-thickness ratio) of 5 or more, preferably 8 or more, in a proportion of at least 50% of the total grains expressed in terms of a projected area can also be used to advantage.

The silver chlorobromide emulsions which can be used in the present invention can be prepared by known methods as described in P. Grafkides, *Chemie et Physique Photographique*, Paul Montel (1967), G. F. Duffin, *Photographic Emulsion Chemistry*, The Focal Press (1966), and V. L. Zelikan, et al., *Making and Coating Photographic Emulsion*, The Focal Press (1964). More specifically, the emulsions can be prepared using the acid process, the neutral process, the ammonia process, etc. The reaction between a soluble silver salt and a soluble halogen salt can be carried out by a single jet process, a double jet process, a combination thereof, and the like.

The so-called reverse mixing process in which silver halide grains are formed in the presence of excess silver ions may also be used. The so-called controlled doublet jet process in which the pAg value of a liquid phase in which the silver halide grains are formed is maintained constant, may also be employed. A silver halide emulsion comprising grains having a regular crystal form and a nearly uniform grain size can be prepared using this process.

Various polyvalent metal ion impurities may be introduced into the silver halide emulsions which can be used in the present invention during silver halide grain formation or the subsequent physical ripening. Examples of useful compounds therefor include salts of cadmium, zinc, lead, copper, and thallium; and salts or complex salts of the group VIII metals, e.g., iron, ruthenium, rhodium, palladium, osmium, iridium, and platinum. The group VIII metal compounds are particularly preferred. These compounds are preferably used in an amount of from $1\times10^{-9}$ to $1\times10^{-2}$ mol per mol of silver halide, though the amount can vary widely depending on the end use of the light-sensitive material.

The silver halide emulsions are usually subjected to chemical sensitization and spectral sensitization.

Chemical sensitization of the silver halide emulsions can be achieved by sulfur sensitization represented by the addition of instable sulfur compounds, reduction sensitization, noble metal sensitization represented by gold sensitization or other known techniques, either alone or as a combination thereof. Compounds which can be preferably used for chemical sensitization are described in JP-A-62-215272, pp. 18–22.

Spectral sensitization is conducted to sensitize the emulsion of each light-sensitive layer to a spectral sensitivity in a desired light wavelength region. Spectral sensitization is preferably carried out by adding a dye which absorbs light of the wavelength region corresponding to the desired spectral sensitivity, i.e., a spectral sensitizing dye. Examples of suitable spectral sensitizing dyes include those described, e.g., in F. M. Harmer, *Heterocyclic Compounds-Cyanine Dyes and Relates Compounds*, John Wiley & Sons, New York, London (1964). Specific examples of preferred sensitizing dyes and the spectral sensitization method are described in JP-A-62-215272, pp. 22–38.

Various antifoggants or stabilizers or precursors thereof can be introduced into the photographic emulsions to prevent fog during preparation, preservation or photographic processing of light-sensitive materials or to stabilize the photographic performance properties of the light-sensitive materials. Specific examples of suitable compounds are described in JP-A-62-215272, pp. 39–72.

The emulsions which can be used in the present invention may be either a surface latent image type forming a latent image predominantly on the grain surface or an internal latent image type forming a latent image predominantly on the inside of the grain.

The color light-sensitive materials which can be used in the present invention generally contain yellow, magenta, and cyan oil-soluble couplers which develop yellow, magenta and cyan colors, respectively, on coupling with the oxidation product of an aromatic amine color developing agent.

Cyan, magenta, and yellow oil-soluble couplers which are preferred for use in the present invention are represented by formulae (C-I), (C-II), (M-I), (M-II) and (Y) shown below, respectively.

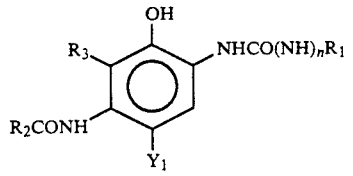

(C-I)

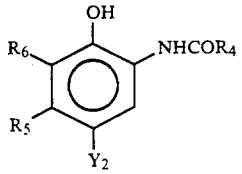

(C-II)

-continued

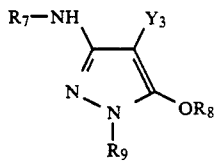

(M-I)

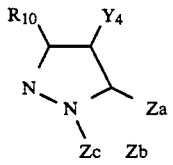

(M-II)

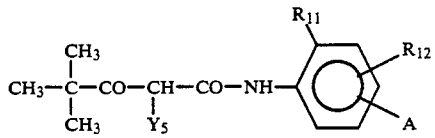

(Y)

In formulae (C-I) and (C-II), $R_1$, $R_2$, and $R_4$ each represents a substituted or unsubstituted aliphatic, aromatic or heterocyclic group; $R_3$, $R_5$, and $R_6$ each represents a hydrogen atom, a halogen atom, an aliphatic group, an aromatic group or an acylamino group; or $R_3$ represents a non-metal atomic group forming a 5- or 6-membered nitrogen-containing ring together with $R_2$; $Y_1$ and $Y_2$ each represents a hydrogen atom or a group releasable on coupling with an oxidation product of a developing agent; and n represents 0 or 1.

$R_5$ in formula (C-II) preferably represents an aliphatic group, e.g., methyl, ethyl, propyl, butyl, pentadecyl, t-butyl, cyclohexyl, cyclohexylmethyl, phenylthiomethyl, dodecyl, oxyphenylthiomethyl, butaneamidomethyl, and methoxymethyl groups.

Of the cyan couplers represented by formula (C-I) or (C-II), the following compounds are preferred.

In formula (C-I), $R_1$ preferably represents an aryl group or a heterocyclic group, and more preferably an aryl group substituted with a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group. When $R_3$ and $R_2$ do not form a ring, $R_2$ preferably represents a substituted or unsubstituted alkyl or aryl group, and more preferably an alkyl group substituted with a substituted aryloxy group, and $R_3$ preferably represents a hydrogen atom.

In formula (C-II), $R_4$ preferably represents a substituted or unsubstituted alkyl or aryl group, and more preferably an alkyl group substituted with a substituted aryloxy group. $R_5$ preferably represents an alkyl group having from 2 to 15 carbon atoms or a methyl group having a substituent containing at least one carbon atom. Substituents for the methyl group preferably include an arylthio group, an alkylthio group, an acylamino group, an aryloxy group, and an alkyloxy group. $R_5$ more preferably represents an alkyl group having from 2 to 15 carbon atoms, particularly from 2 to 4 carbon atoms. $R_6$ preferably represents a hydrogen atom or a halogen atom, and more preferably a chlorine atom or a fluorine atom.

In formulae (C-I) and (C-II), $Y_1$ and $Y_2$ each preferably represents a hydrogen atom, a halogen atom, an alkoxy group, an aryloxy group, an acyloxy group, or a sulfonamido group.

In formula (M-I), $R_7$ and $R_9$ each represents an aryl group; $R_8$ represents a hydrogen atom, an aliphatic or aromatic acyl group, or an aliphatic or aromatic sulfonyl group; and $Y_3$ represents a hydrogen atom or a releasable group (e.g., a substituted or unsubstituted arylthio group, a substituted or unsubstituted aryloxy group, a substituted or unsubstituted triazolyl group, a substituted or unsubstituted tetrazolyl group, etc.).

In formula (M-I), the substituents for the aryl group (preferably a phenyl group) represented by $R_7$ or $R_9$ are the same as for $R_1$. When two or more substituents are present, they may be the same or different. $R_8$ preferably represents a hydrogen atom, an aliphatic acyl group, or an aliphatic sulfonyl group, and more preferably a hydrogen atom. $Y_3$ preferably represents a group releasable at any of a sulfur, oxygen and nitrogen atom. For example, sulfur-releasable groups as described in U.S. Pat. No. 4,351,897 and International Publication WO 88/04795 are particularly preferred.

In formula (M-II), $R_{10}$ represents a hydrogen atom or a substituent such as an alkyl, alkoxy, aryloxy, acyl, carbamoyl or oxycarbonyl group which may be substituted; $Y_4$ represents a hydrogen atom or a releasable group (e.g., a halogen atom, a substituted or unsubstituted arylthio group, a substituted or unsubstituted aryloxy group, a substituted or unsubstituted triazolyl group, a substituted or unsubstituted tetrazolyl group, etc.), and preferably a halogen atom or an arylthio group; $Z_a$, $Z_b$, and $Z_c$ each represents a methine group, a substituted methine group, =N—, or —NH—; either one of the $Z_a$—$Z_b$ bond and $Z_b$—$Z_c$ bond is a double bond, with the other being a single bond; when the $Z_b$—$Z_c$ bond is a carbon-carbon double bond, it may be a part of an aromatic ring; and formula (M-II) may form a polymer inclusive of a dimer, at any of $R_{10}$, $Y_4$, or a substituted methine group represented by $Z_a$, $Z_b$ or $Z_c$.

Of the pyrazoloazole couplers of formula (M-II), imidazo[1,2-b]pyrazoles described in U.S. Pat. No. 4,500,630 are preferred from the standpoint of reduced yellow side absorption and fastness to light. Pyrazolo[1,5-b][1,2,4]triazoles described in U.S. Pat. No. 4,540,654 are particularly preferred.

Additional examples of suitable pyrazoloazole couplers include pyrazolotriazole couplers having a branched alkyl group at the 2-, 3- or 6-position of the pyrazolotriazole ring as described in JP-A-61-65245; pyrazoloazole couplers containing a sulfonamido group in the molecule thereof as described in JP-A-61-65246; pyrazoloazole couplers having an alkoxyphenylsulfonamido ballast group as described in JP-A-61-147254; and pyrazolotriazole couplers having an alkoxy group or an aryloxy group at the 6-position as described in European Patent Publication Nos. 226,849 and 294,785.

In formula (Y), $R_{11}$ represents a halogen atom, an alkoxy group, a trifluoromethyl group, or an aryl group; $R_{12}$ represents a hydrogen atom, a halogen atom, or an alkoxy group; A represents —$NHCOR_{13}$, —$NHSO_2$—$R_3$, —$SO_2NHR_{13}$, —$COOR_{13}$, or —$SO_2N(R_{14})$—$R_{13}$ (wherein $R_{13}$ and $R_{14}$ each represents an alkyl group, an aryl group, or an acyl group); and $Y_5$ represents a releasable group. The substituents for $R_2$, $R_{13}$, or $R_{14}$ are the same as for $R_1$. The releasable group $R_5$ is preferably a group releasable at an oxygen atom or a nitrogen atom, and more preferably a nitrogen-releasable group.

Specific examples of the couplers represented by formulae (C-I), (C-II), (M-I), (M-II), and (Y) are shown below.

| compound | |
|---|---|
| (C-1) | 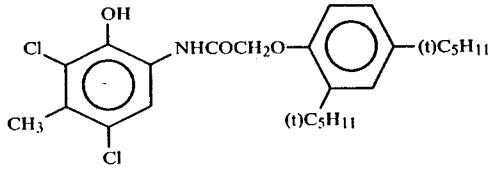 |
| (C-2) | 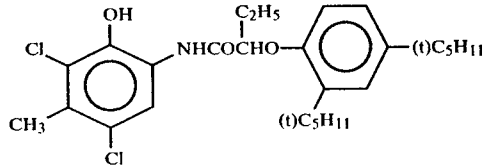 |
| (C-3) | 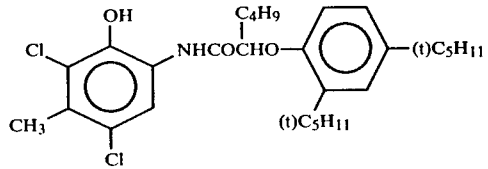 |
| (C-4) | 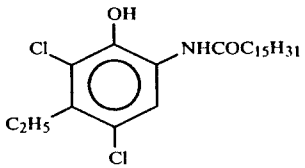 |
| (C-5) | 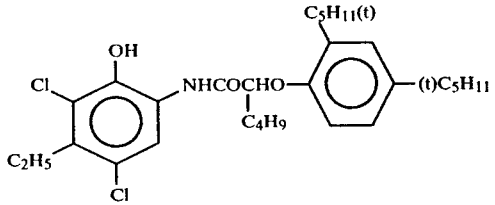 |

-continued
| compound | |
|---|---|
| (C-6) | 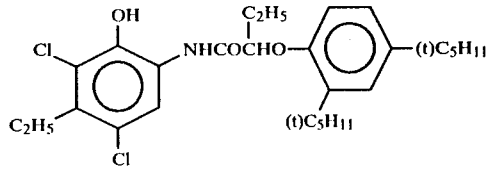 |
| (C-7) | 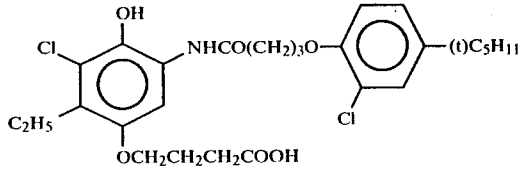 |
| (C-8) | 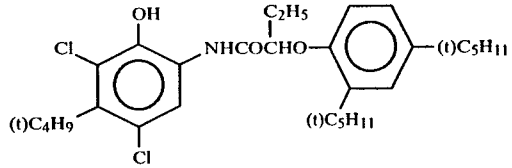 |
| (C-9) | 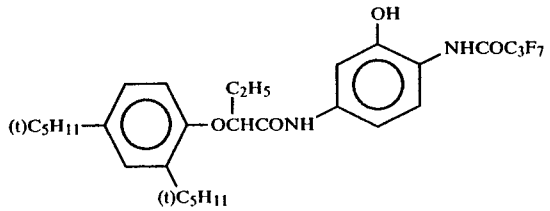 |
| (C-10) | 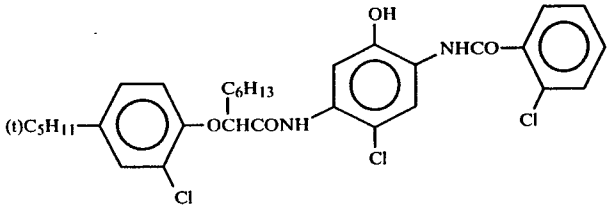 |

-continued
| compound | |
|---|---|
| (C-11) | 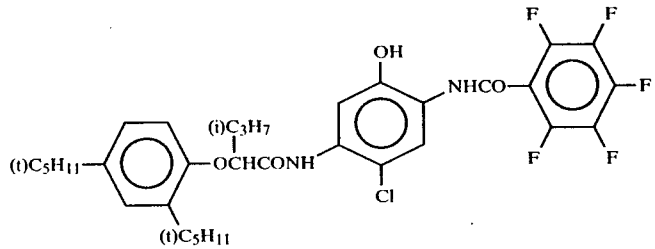 |
| (C-12) | 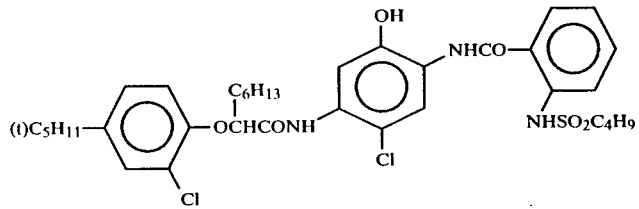 |
| (C-13) | 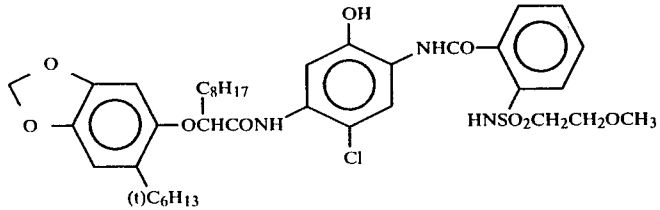 |
| (C-14) | 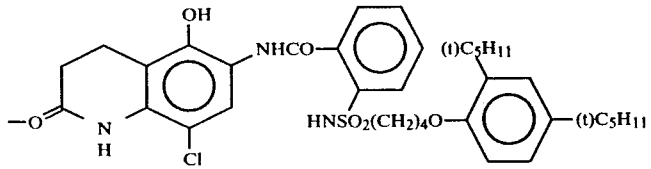 |

-continued
| compound | |
|---|---|
| (C-15) | 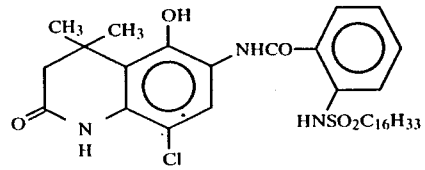 |
| (C-16) | 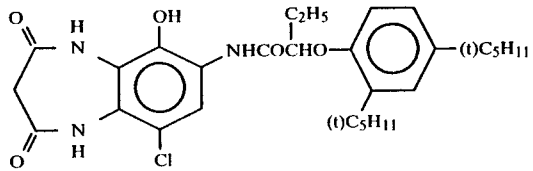 |
| (C-17) | 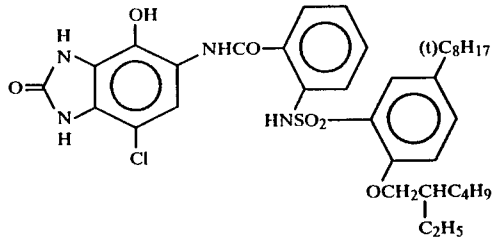 |
| (C-18) | 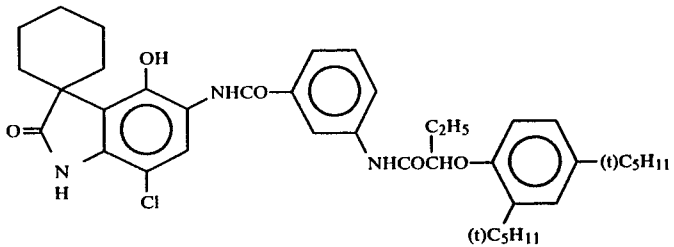 |

-continued
compound
(C-19)
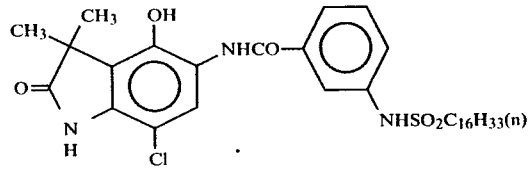
(C-20)
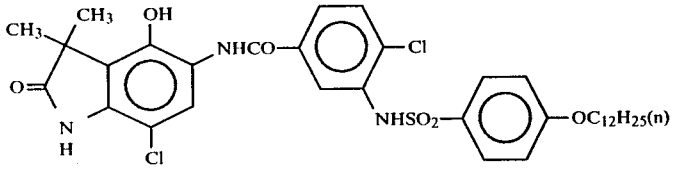
(C-21)
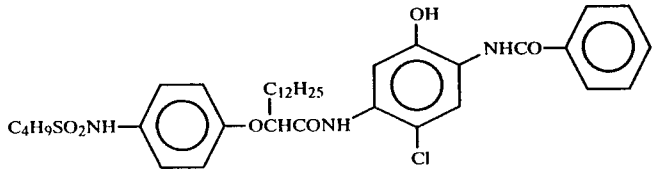
(C-22)
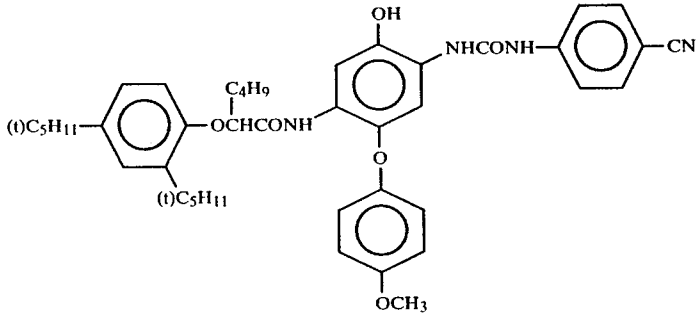

-continued
| compound | |
|---|---|
| (M-1) | 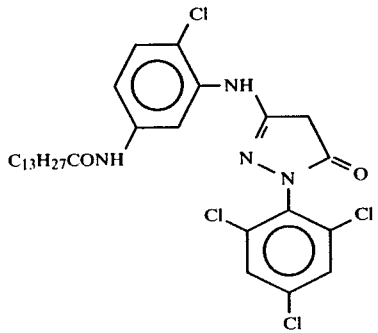 |
| (M-2) | 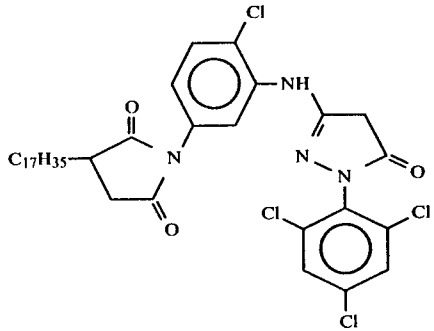 |
| (M-3) | 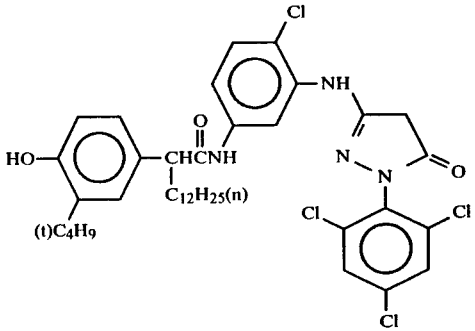 |

-continued
| compound | |
|---|---|
| (M-4) | 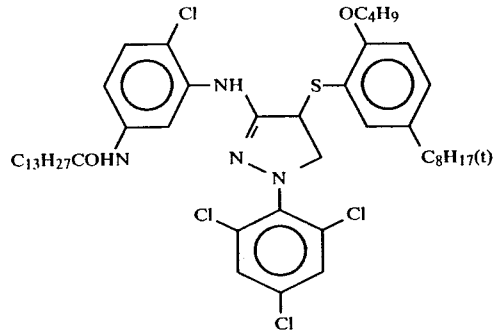 |
| (M-5) | 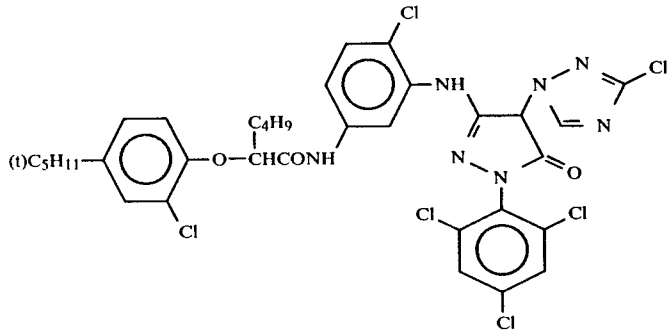 |
| (M-6) | 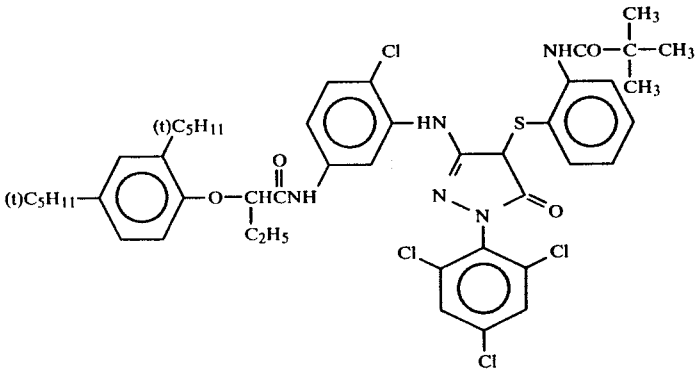 |

-continued
| compound | |
|---|---|
| (M-7) | 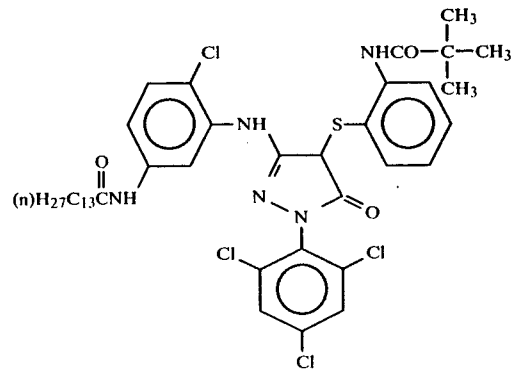 |
| (M-8) | 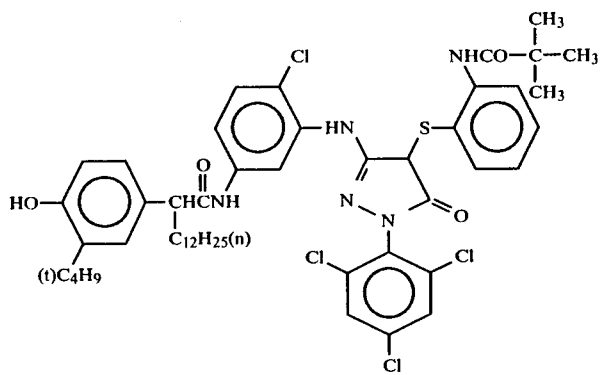 |
| $R_{10}$ | $R_{15}$ | $Y_4$ |
|---|---|---|
| 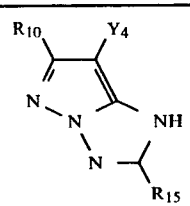 | | |

-continued
| compound | | | |
|---|---|---|---|
| M-9 | $CH_3$— | 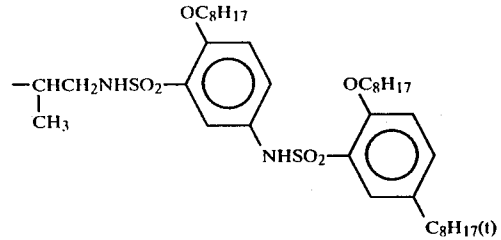 | Cl |
| M-10 | " | 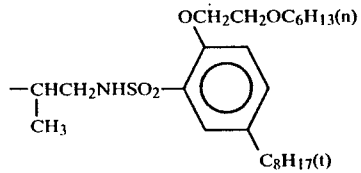 | " |
| M-11 | $(CH_3)_3C$— | 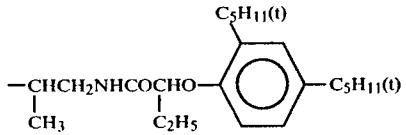 | 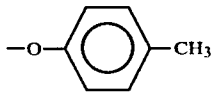 |
| M-12 | 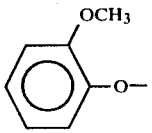 | 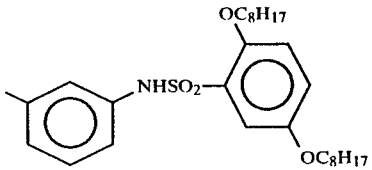 | 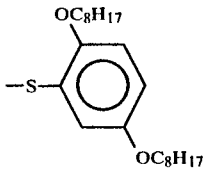 |
| M-13 | $CH_3$— | 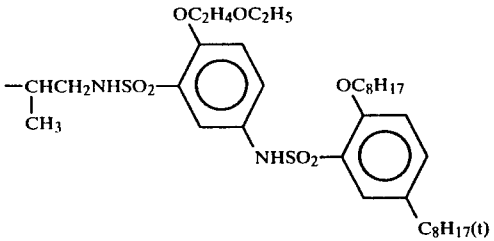 | Cl |

-continued
| compound | | | |
|---|---|---|---|
| M-14 | " | 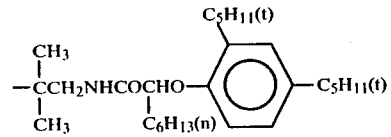 | " |
| M-15 | " | 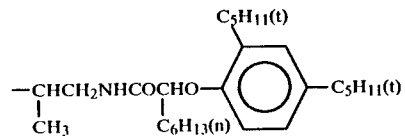 | " |
| M-16 | $CH_3$— | 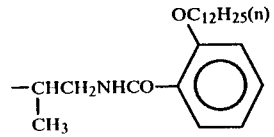 | Cl |
| M-17 | " | 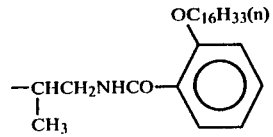 | " |
| M-18 | 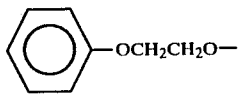 | 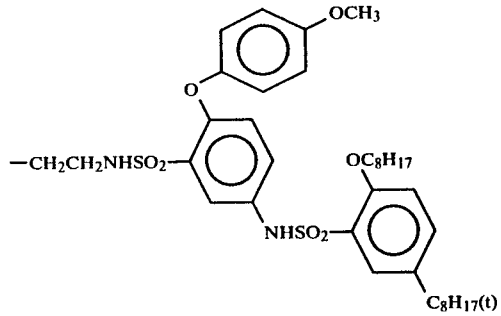 | 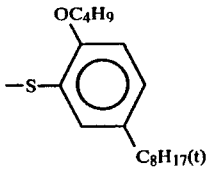 |
| M-19 | $CH_3CH_2O$— | " | " |

-continued
| compound | | | |
|---|---|---|---|
| M-20 | 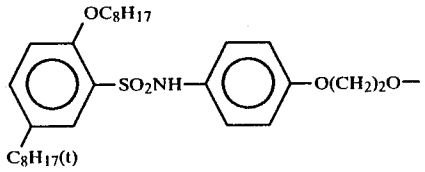 | 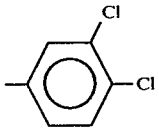 | 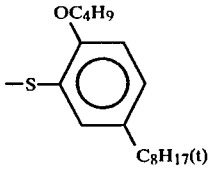 |
| M-21 | 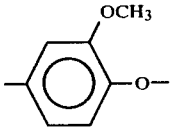 | 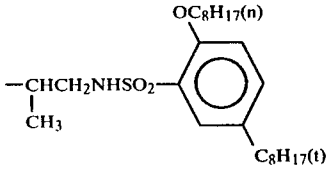 | Cl |
| | 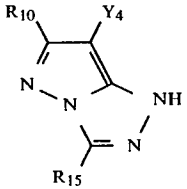 | | |
| M-22 | $CH_3$— | 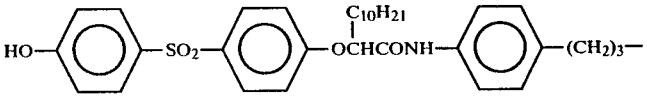 | Cl |
| M-23 | " | 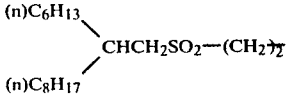 | " |
| M-24 | 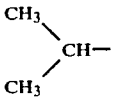 | 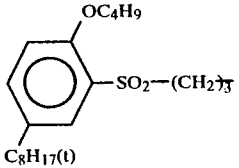 | " |

-continued
| compound | | | |
|---|---|---|---|
| M-25 | 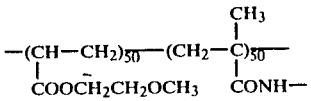 | 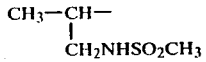 | " |
| M-26 | 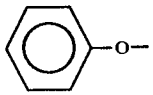 | 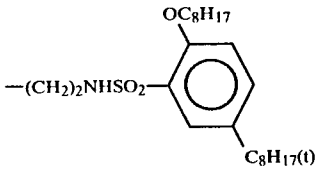 | Cl |
| M-27 | $CH_3$— | 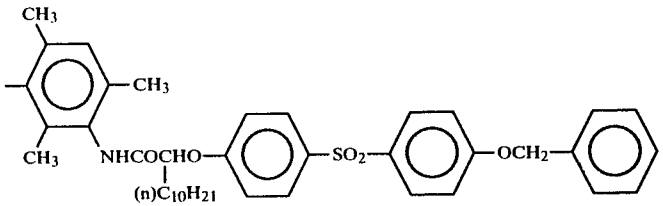 | " |
| M-28 | $(CH_3)_3C$— | 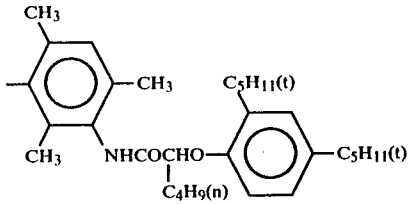 | " |
| M-29 | 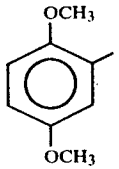 | 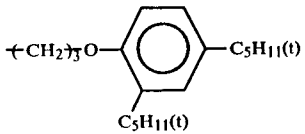 | Cl |
| M-30 | $CH_3$— | 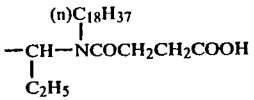 | " |

-continued
| compound | |
|---|---|
| (Y-1) | 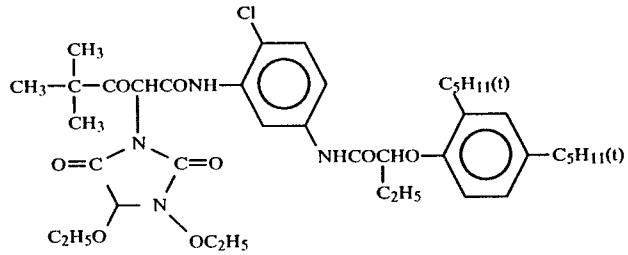 |
| (Y-2) | 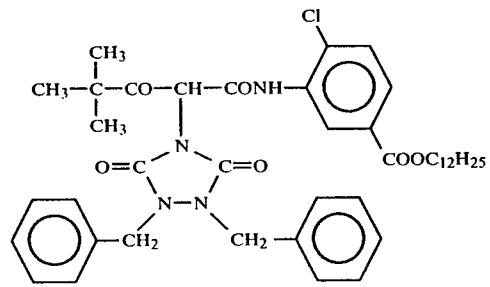 |
| (Y-3) | 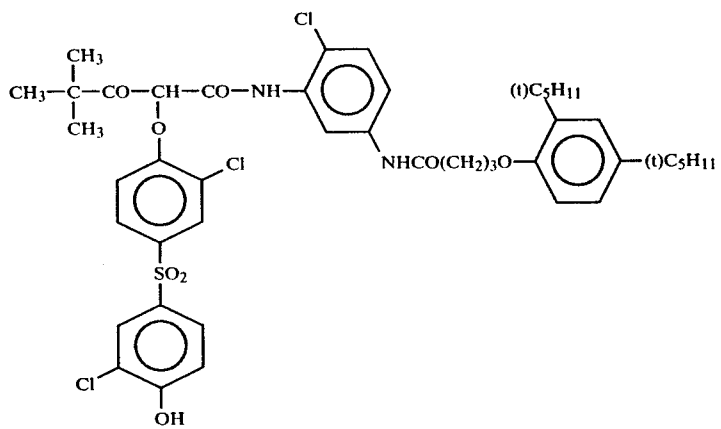 |

-continued
| compound | |
|---|---|
| (Y-4) | 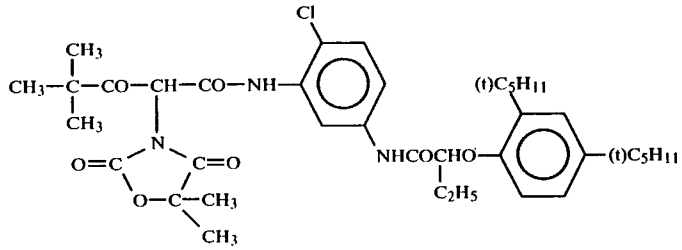 |
| (Y-5) | 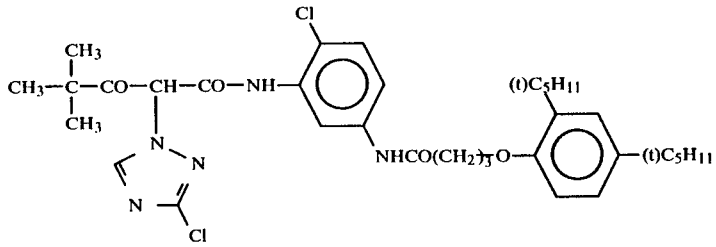 |
| (Y-6) | 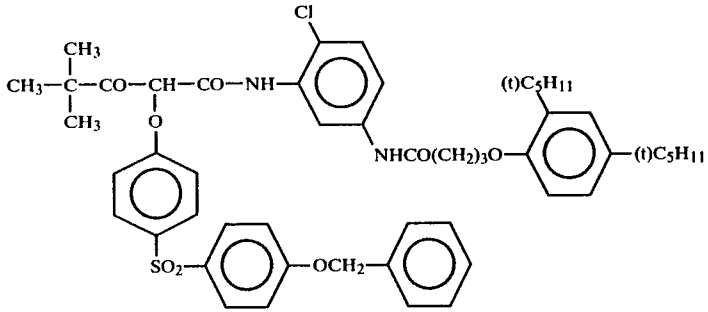 |

-continued
| compound | |
|---|---|
| (Y-7) | 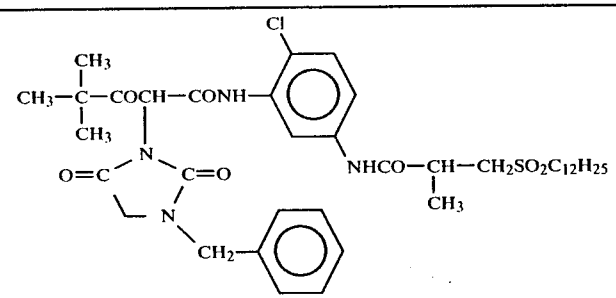 |
| (Y-8) | 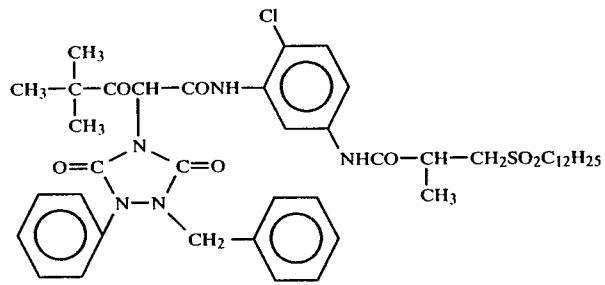 |
| (Y-9) | 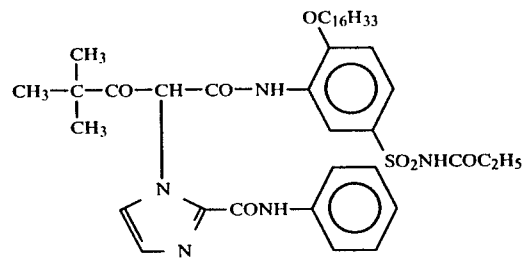 |

The coupler represented by formula (C-I), (C-II), (M-I), (M-II) or (Y) is present in a light-sensitive silver halide emulsion layer in an amount usually of from 0.1 to 1.0 mol, preferably from 0.1 to 0.5 mol, per mol of silver halide.

The coupler can be incorporated into a light-sensitive layer using various known methods. The coupler is generally added using an oil-in-water dispersion method known as an oil protection method, in which it is dissolved in a solvent and then emulsified and dispersed in a gelatin aqueous solution containing a surface active agent. Alternatively, water or a gelatin aqueous solution may be added to a coupler solution containing a surface active agent to obtain an oil-in-water dispersion through phase reversal. An alkali-soluble coupler may be dispersed by using the so-called Fischer's dispersion method. Any low-boiling organic solvent present in the coupler dispersion may be removed by distillation, noodle washing, ultrafiltration or a like technique before mixing the dispersion with a photographic emulsion.

The dispersing medium which can be used in the above-described dispersion methods preferably include high-boiling organic solvents and/or water-insoluble high polymeric compounds having a dielectric constant (at 25° C.) of from 2 to 20 and a refractive index (at 25° C.) of from 1.5 to 1.7.

Suitable high-boiling organic solvents preferably include those represented by formula (A) to (E).

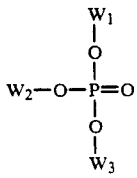

(A)

$W_1-COO-W_2$ (B)

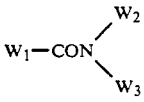

(C)

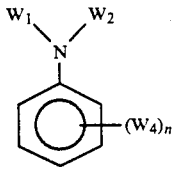

(D)

$W_1-O-W_2$ (E)

wherein $W_1$, $W_2$, and $W_3$ each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ represents $W_1$, $OW_1$, or $S-W_1$; and n represents an integer of from 1 to 5; when n is 2 or greater, the plural $W_4$'s may be the same or different; $W_1$ and $W_2$ in formula (E) may form a condensed ring.

In addition to the compounds of formulae (A) to (E), water-immiscible high-boiling organic solvents having a melting point of not higher than 100° C. and a boiling point of not lower than 140° C. may also be used as long as they are good solvents for couplers. The high-boiling organic solvents to be used preferably have a melting point of 80° C. or lower and a boiling point of 160° C. or higher, and more preferably 170° C. or higher.

The details of these high-boiling organic solvents are disclosed in JP-A-62-215272, pp. 137–144.

It is also possible to impregnate the coupler into a loadable latex polymer (described, e.g., in U.S. Pat. No. 4,203,716) in the presence or absence of the above-described high-boiling organic solvent or dissolved in a water-insoluble and organic solvent-soluble polymer and emulsified and dispersed in a hydrophilic colloid aqueous solution. The homo-or copolymers described in International Publication WO 88/00723, pp. 12–30 are preferably employed. In particular, acrylamide polymers are preferred from the standpoint of dye image stability.

The light-sensitive material which can be used in the present invention may contain hydroquinone derivatives, aminophenol derivatives, gallic acid derivatives, ascorbic acid derivatives, etc. as a color fog inhibitor.

The light-sensitive material may also contain various discoloration inhibitors. Examples of suitable organic discoloration inhibitors for cyan, magenta and/or yellow images include hydroquinones, 6-hydroxychromans, 5-hydroxycoumarans, spirochromans, p-alkoxyphenols, hindered phenols chiefly including bisphenols, gallic acid derivatives, methylenedioxybenzenes, aminophenols, hindered amines, and ether or ester derivatives of these phenol compounds obtained by silylating or alkylating the phenolic hydroxyl group thereof. Metal complexes, such as (bissalicylaldoximato)nickel complexes and (bis-N,N-dialkyldithiocarbamato)nickel complexes, are also useful.

Specific examples of these organic discoloration inhibitors are the hydroquinones described in U.S. Pat. Nos. 2,360,290, 2,418,613, 2,700,453, 2,701,197, 2,728,659, 2,732,300, 2,735,765, 3,982,944, and 4,430,425, British Patent 1,363,921, and U.S. Pat. Nos. 2,710,801 and 2,816,028; the 6-hydroxychromans, 5-hydroxycoumarans, and spirochromans disclosed in U.S. Pat. Nos. 3,432,300, 3,573,050, 3,574,627, 3,698,909, and 3,764,337, and JP-A-52-152225; spiroindanes disclosed in U.S. Pat. No. 4,360,589; p-alkoxyphenols disclosed in U.S. Pat. No. 2,735,765, British Patent 2,066,975, JP-A-59-10539, and JP-B-57-19765; hindered phenols disclosed in U.S. Pat. No. 3,700,455, JP-A-52-72224, U.S. Pat. No. 4,228,235, and JP-B-52-6623; gallic acid derivatives, methylenedioxybenzenes, and aminophenols disclosed in U.S. Pat. Nos. 3,457,079 and 4,332,886, and JP-B-56-21144; hindered amines disclosed in U.S. Pat. Nos. 3,336,135 and 4,268,593, British Patents 1,326,889, 1,354,313, and 1,410,846, JP-B-51-1420, JP-A-58-114036, JP-A-59-53846, and JP-A-59-78344; and metal complexes disclosed in U.S. Pat. Nos. 4,050,938 and 4,241,155 and British Patent 2,027,731(A). These compounds are co-emulsified together with the coupler in an amount usually of from 5 to 100% by weight based on the coupler and added to a light-sensitive layer.

An ultraviolet absorbent can be incorporated into a cyan-forming layer and both layers adjacent thereto to more effectively present fading of a cyan dye image due to heat and particularly light.

Examples of suitable ultraviolet absorbents include benzotriazole compounds having an aryl substituent as described, e.g., in U.S. Pat. No. 3,533,794; 4-thiazolidone compounds as described, e.g., in U.S. Pat. Nos. 3,314,794 and 3,352,681; benzophenone compounds as described, e.g., in JP-A-46-2784; cinnamic ester compounds as described, e.g., in U.S. Pat. Nos. 3,705,805 and 3,707,395; butadiene compounds as described, e.g., in U.S. Pat. No. 4,045,229; and benzoxydol compounds as described, e.g., in U.S. Pat. Nos. 3,406,070, 3,677,672, and 4,271,307. Ultraviolet absorbing couplers (e.g., α-naphthol type cyan-forming couplers) or ultraviolet absorbing polymers are also useful. These ultraviolet absorbents may be mordanted in a specific layer. Of these ultraviolet absorbents, preferred are benzotriazole compounds having an aryl substituent.

The above-described couplers, particularly pyrazoloazole couplers are preferably used in combination with (F) a compound capable of chemically bonding to residual aromatic amine developing agent remaining after color development to form a chemically inactive and substantially colorless compound and/or (G) a compound capable of chemically bonding to a residual oxidation product of an aromatic amine developing agent remaining after color development to form a chemically inactive and substantially colorless compound. Such a combined use is advantageous to prevent staining and other side effects during preservation after processing which are due to a colored dye formation reaction between residual color developing agent or an oxidation product thereof and the coupler.

Compounds (F) preferably include compounds which react with p-anisidine with a rate constant of a second-odor reaction $k_2$ falling within a range of from 1.0 l/mol.sec to $1\times10^{-5}$ l/mol.sec (in trioctyl phosphate at 80° C.). The rate constant can be determined by the method described in JP-A-63-158545.

When $k_2$ is greater than the above range, the compound per se tends to be labile and to decompose on reacting with gelatin or water. Where $k_2$ is smaller than that range, the reaction with residual aromatic amine developing agent is too slow to prevent side effects due to the residual aromatic amine developing agent.

Preferred of compounds (F) are those represented by formulae (FI) and (FII):

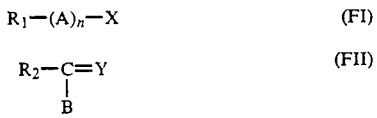

$$R_1-(A)_n-X \quad \text{(FI)}$$

$$R_2-\underset{\underset{B}{|}}{C}=Y \quad \text{(FII)}$$

wherein $R_1$ and $R_2$ each represents an aliphatic group, an aromatic group, or a heterocyclic group; n represents 1 or 0; A represents a group capable of reacting with an aromatic amine developing agent to form a chemical bond; X represents a group which is released on reaction with an aromatic amine developing agent; B represents a hydrogen atom, an aliphatic group, an aromatic group, a heterocyclic group, an acyl group, or a sulfonyl group; and Y represents a group which accelerates addition of an aromatic amine developing agent to the compound (FII); and $R_1$ and X, or Y and $R_2$ or B may combine to form a cyclic structure.

The mode of chemically bonding to residual aromatic amine developing agent typically includes a substitution reaction and an addition reaction.

Specific examples of compounds of formulae (FI) and (FII) preferably include those described in JP-A-63-158545, JP-A-62-283338, and European Patent Publication Nos. 298321 and 277589.

Compounds (G) preferably include those represented by formulae (GI):

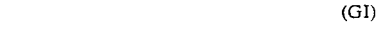

$$R\text{-}Z \quad \text{(GI)}$$

wherein R represents an aliphatic group, an aromatic group, or a heterocyclic group; and Z represents a nucleophilic group or a group capable of releasing a nucleophilic group on decomposition in a light-sensitive material.

In formula (GI), Z is preferably a group having a Pearson's nucleophilicity $^{n}CH_3I$ value (see R. G. Pearson, et al., *J. Am. Chem. Soc.*, Vol. 90, p. 319 (1968)) of 5 or more or a group derived therefrom.

Specific examples of compounds represented by formula (GI) preferably include those described in European Patent Publication No. 255722, JP-A-62-143048, JP-A-62-229145, JP-A-1-230039 and JP-A-1-57259, European Patent Publication Nos. 298321 and 277589.

Combinations of compounds (G) and compounds (F) are described in detail in European Patent Publication No. 277589.

The hydrophilic colloidal layers of the light-sensitive material may contain water-soluble dyes or dyes which become water-soluble by photographic processing as a filter dye or to prevent irradiation or halation or for other various purposes. These dyes include oxonol dyes, hemioxonol dyes, styryl dyes, merocyanine dyes, cyanine dyes, and azo dyes. In particular, oxonol dyes, hemioxonol dyes, and merocyanine dyes are useful.

Binders or protective colloids which can be used in the emulsion layers include gelatin advantageously. Other hydrophilic colloids may also be used either alone or in combination with gelatin.

The gelatin to be used in the present invention may be either lime-processed gelatin or acid-processed gelatin. The details of the preparation of gelatin are described in Arthur Vice, *The Macromolecular Chemistry of Gelatin*, Academic Press (1964).

For example, hydrophilic colloids other than gelatin which can be used in this invention include gelatin derivatives; graft polymers of gelatin and other polymers and proteins such as albumin and casein; cellulose derivatives such as hydroxyethylcellulose, carboxymethylcellulose hydroxypropylcellulose and cellulose sulfate esters; sodium alginate; sugar derivatives such as pyrodextran and starch derivatives; and homopolymers such as poly(vinyl alcohol), partially acetalated poly(vinyl alcohol), poly(vinyl alcohol) which has been modified with anionic compounds and cationic compounds; poly(N-vinylpyrrolidone); poly(acrylic acid) and the neutralized products thereof; poly(methacrylic acid) and the neutralized products thereof; polyacrylamide, polyvinylimidazole and polyvinylpyrazole for example; and copolymers of these materials.

The hydrophilic polymers included in the gelatin can be crosslinked appropriately and used to increase the initial swelling.

The total amount of hydrophilic colloid used in the light-sensitive material is preferably from 2.0 to 8.0 g/m$^2$ and most desirably from 3.5 to 6.0 g/m$^2$. If the amount of hydrophilic colloid is large then development, and especially the initial development, is retarded. If the amount of hydrophilic colloid is too low this has an effect on the physical properties of the film while it is wet and this is undesirable.

All the well known film hardening agents can be used, either individually or in combinations, in this invention.

For example, use can be made of chromium salts (for example, chrome alum, chromium acetate); aldehydes (for example, formaldehyde, glyoxal, glutaraldehyde); N-methylol compounds (for example, dimethylolurea, methyloldimethylhydantoin); dioxane derivatives (for example, 2,3-dihydroxydioxane); active vinyl compounds (for example, 1,3,5-triacryloyl-hexahydro-2-triazine, 1,3-vinylsulfonyl-2-propanol); active halogen compounds (for example, 2,4-dichloro-6-hydroxy-3-triazine); and mucohalogen acids (for example, mucochloric acid, mucophenoxychloric acid).

The film hardening agents preferred for use include, for example, aldehyde based compounds such as formaldehyde and glyoxal; s-triazine based compounds such as 2-hydroxy-4,6-dichlorotriazine sodium salt; and vinylsulfone based compounds.

The amount of film hardening agent used is affected by the presence of film hardening promotors or film hardening restrainers, but the use of an amount within the range from $1\times10^{-6}$ mol/gram of gelatin to $1\times10^{-2}$ mol/gram of gelatin is preferred. Most desirably, the amount used is within the range from $5\times10^{-5}$ mol/gram of gelatin to $5\times10^{-3}$ mol/gram of gelatin.

Examples of film hardening agents include those indicated below.

HCHO 1

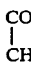

2

$CH_3CHO$ 3

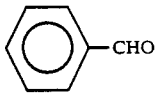

4

$OHC{\leftarrow}CH_2{\rightarrow}_5CHO$ 5

$ClCH_2CONHCOCH_2Cl$ 6

$ClCH_2COOCH_2CH_2OOCCH_2Cl$ 7

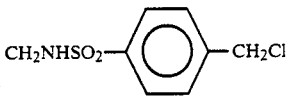

8

$CH_3COCl$ 9

$CH_3COCH_2Cl$ 10

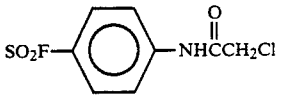

11

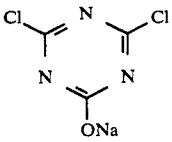

12

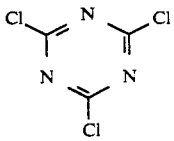

13

-continued

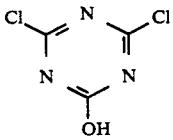

14

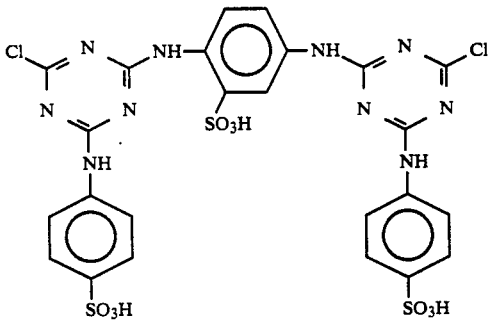

15

$CH_2{=}CHSO_2(CH_2)_3SO_2CH{=}CH_2$ 16

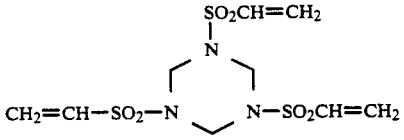

17

$C(CH_2SO_2CH{=}CH_2)_4$ 18

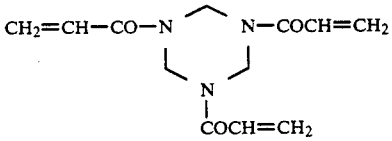

19

$CH_2{=}CHCOOCOCH{=}CH_2$ 20

$CH_2{=}CH{-}O{-}CH{=}CH_2$ 21

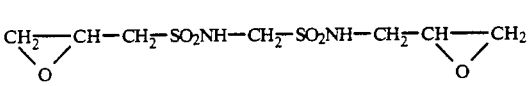

22

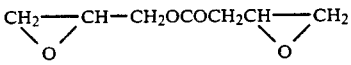

23

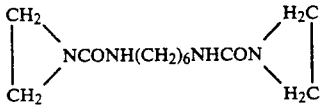

24

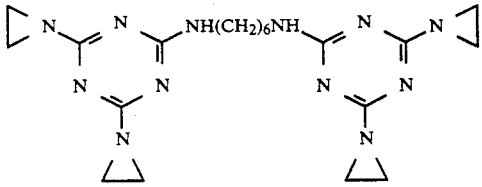

25

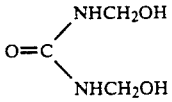

26

-continued

27

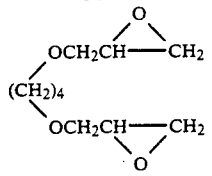

28

$(CH_2{=}CHSO_2{\cdot}CH_2CONHCH_2)_2$

Film hardening promotors may be used when using these film hardening agents to harden a hydrophilic colloid film. Agents which break down hydrogen bonding such as thiourea and urea, and aromatic hydrocarbons which have hydroxy groups such as hydroquinone, can be cited as film hardening promotors.

Moreover, the film hardening agents can be polymerized and only the layer to which they are added can be hardened.

The transparent films, such as cellulose nitrate films and poly(ethylene terephthalate) films, and reflective supports generally used in photographic materials can be used as the supports in this invention. The use of reflective supports is preferred in view of the aims of the invention.

The term "reflective supports" used in this invention are supports which have a high reflectivity and make the dye image which is formed in the silver halide emulsion layer bright. These include supports which have been covered with a hydrophobic resin which contains a dispersion of light reflecting material, such as titanium oxide, zinc oxide, calcium carbonate or calcium sulfate; and supports comprising a hydrophobic resin in which a light reflecting substance is included. Examples of such supports include baryta paper; polyethylene coated paper; polypropylene based synthetic paper and transparent supports, such as glass plates; polyester films such as poly(ethylene terephthalate); cellulose triacetate and cellulose nitrate films; polyamide films; polycarbonate films; and polystyrene films and vinyl chloride resins on which a reflective layer has been established or in which a reflective substance is used conjointly.

Supports which have a metal surface with mirror like reflection properties or secondary diffuse reflection properties can also be used as reflective type supports. The spectral reflectance in the visible wavelength region of a metal surface is at least 0.5, and diffuse reflection properties may be obtained by roughening the surface or by using a metal powder. Aluminum, tin, silver, magnesium or alloys thereof can be used, for example, for the metal; and the surface may take the form of a metal sheet, a metal foil or a thin metal surface layer obtained by rolling, vapor deposition or plating for example. From among these materials, those obtained by vapor depositing metal on some other substrate are preferred. The establishment of a water-resistant resin, and preferably a thermoplastic resin layer over the metal surface is desirable. An anti-static layer may also be established on the side opposite to the metal surface side of the support in this invention. Details of such supports have been disclosed, for example, in JP-A-61-210346, JP-A-63-24247, JP-A-63-24251, and JP-A-63-24255.

These supports can be selected appropriately according to the intended use.

The use of a white pigment which has been milled thoroughly in the presence of a surfactant and of which the particle surfaces have been treated with a dihydric to tetrahydric alcohol is preferred for the light reflecting substance.

The occupied surface ratio of fine white pigment particles per specified unit area (%) of fine white pigment particles can be determined most typically by dividing the area under observation into adjoining 6×6 μm unit areas and measuring the occupied area ratio (%) ($R_i$) of the fine particles projected in each unit area. The variation coefficient of the occupied area ratio (%) can be obtained by means of the ratio s/R of the standard deviation of s for $R_i$ with respect to the average value (R) of $R_i$. The number of unit areas taken for observation (n) is preferably at least six. Hence, the variation coefficient can be obtained by means of the following expression:

$$\sqrt{\frac{\sum_{n=1}^{n}(Ri-R)^2}{n-1}} \Big/ \frac{\sum_{i=1}^{n} Ri}{n}$$

In this invention, the variation coefficient of the occupied area ratio (%) of fine pigment particles is not more than 0.15, and preferably not more than 0.12. The diffusion properties of the particles can be said to be "uniform" in practice in those cases where the value is not more than 0.08.

The color photographic materials in this invention are preferably subjected to color development, bleach-fixing and water washing (or stabilization) processes. Bleaching and fixing can be carried out separately rather than in a single bath as indicated above.

The color developing solution which can be used in the present invention contains a known aromatic primary color developing agent. The color developing agent preferably is a p-phenylenediamine derivative. Typical but non-limiting examples of p-phenylenediamine developing agents are shown below.

| | |
|---|---|
| D-1: | N,N-Diethyl-p-phenylenediamine |
| D-2: | 2-Amino-5-diethylaminotoluene |
| D-3: | 2-Amino-5-(N-ethyl-N-laurylamino)toluene |
| D-4: | 4-[N-Ethyl-N-(β-hydroxyethyl)amino]aniline |
| D-5: | 2-Methyl-4-[N-ethyl-N-(β-hydroxyethyl)amino]aniline |
| D-6: | 4-Amino-3-methyl-N-ethyl-N-(3-hydroxypropyl)aniline |
| D-7: | 4-Amino-3-methyl-N-ethyl-N-β-(methanesulfonamido) ethyl]-aniline |
| D-8: | N-(2-Amino-5-diethylaminophenylethyl) methanesulfonamide |
| D-9: | N,N-Dimethyl-p-phenylenediamine |
| D-10: | 4-Amino-3-methyl-N-ethyl-N-methoxyethylaniline |
| D-11: | 4-Amino-3-methyl-N-ethyl-N-β-ethoxyethylaniline |
| D-12: | 4-Amino-3-methyl-N-ethyl-N-β-butoxyethylaniline |

4-[N-Ethyl-N-(β-hydroxyethyl)amino]aniline (D-4) and 4-amino-3-methyl-N-ethyl-N-(3-hydroxypropyl-)aniline (D-6) are particularly preferred of these p-phenylenediamine derivatives.

These p-phenylenediamine derivatives may be in the form of a salt, such as a sulfate, a hydrochloride, a sulfite, and a p-toluenesulfonate salt. The aromatic primary amine developing agent is preferably used in an amount of from about 0.1 g to about 20 g, and more preferably from about 0.5 g to about 12 g, per liter of developing solution.

In carrying out the present invention, it is preferable to use a developing solution containing substantially no benzyl alcohol. The terminology "substantially no benzyl alcohol" as used herein means that the benzyl alcohol concentration is preferably not more than 2 ml/l, more preferably not more than 0.5 ml/l, and most preferably zero.

A developing solution containing substantially no sulfite ion is preferable also serving as a preservative for a developing agent. In addition, sulfite ion has an effect of dissolving silver halide and an effect of reducing dye formation efficiency on reacting with an oxidation product of a developing agent. These effects of sulfite ion seem to be one of causes of an increase of variation in photographic characteristics accompanying continuous processing. The terminology "substantially no sulfite ion" as used herein means that sulfite ion concentration is preferably not more than $3.0\times10^{-3}$ mol/l, and more preferably zero. The sulfite ion as above referred excludes trace amounts of sulfite ion which is used as an antioxidant for a processing kit containing a concentrated developing agent before preparation of a developing solution.

In addition to no substantial sulfite ion being present, the developing solution preferably contains substantially no hydroxylamine. This is because hydroxylamine not only functions as a preservative for a developing solution but has a silver development activity by itself. Therefore, a variation of a hydroxylamine concentration appears to greatly influence the photographic characteristics. The terminology "substantially no hydroxylamine" as used herein means that the amount of hydroxylamine is preferably not more than $5.0\times10^{-3}$ mol/l, and more preferably is zero.

Accordingly, the developing solution preferably contains an organic preservative in place of hydroxylamine or sulfite ion as above-described. The organic preservative referred to herein denotes organic compounds capable of reducing the rate of deterioration of the aromatic primary amine color developing agent, i.e., organic compounds having the function of preventing the oxidation of a color developing agent, e.g., air oxidation. Particularly effective organic preservatives are hydroxylamine derivatives (exclusive of hydroxylamine, hereinafter the same), hydroxamic acids, hydrazines, hydrazides, phenols, β-hydroxyketones, β-aminoketones, saccharides, monoamines, diamines, polyamines, quaternary ammonium salts, nitroxyl radicals, alcohols, oximes, diamide compounds, and condensed cyclic amines. Examples of these organic preservatives are described, e.g., in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020, and JP-B-48-30496.

If desired, the developing solution may further contain, as a preservative, various metals as described in JP-A-57-44148 and JP-A-57-53749, the salicylic acid derivatives described in JP-A-59-180588, alkanolamines described in JP-A-54-3532, polyethyleneimines described in JP-A-56-94349, aromatic polyhydroxyl compounds described in U.S. Pat. No. 3,746,544, etc. In particular, alkanolamines, e.g., triethanolamine, dialkylhydroxylamines, e.g., diethylhydroxylamine, hydrazine derivatives, or aromatic polyhydroxyl compounds are preferred.

Particularly preferred of the above-described organic preservatives are hydroxylamine derivatives and hydrazine derivatives (i.e., hydrazines and hydrazides). Specific examples of these organic preservatives and their use are described in JP-A-1-97953, JP-A-1-186939, JP-A-1-186940, and JP-A-1-187557.

Use of a combination of the above-described hydroxylamine derivative or hydrazine derivative with an amine is more preferred to improve the stability of the color developing solution which leads to improved stability in continuous processing.

Examples of suitable amines which can be used in this combination include cyclic amines as described in JP-A-63-239447, the amines described in JP-A-63-128340, and the amines described in JP-A-1-186939 and JP-A-1-187557.

The color developing solution to be used in the present invention preferably contains $3.5\times10^{-2}$ to $1.5\times10^{-1}$ mol/l, and particularly from $4\times10^{-2}$ to $1\times10^{-1}$ mol/l, of chloride ion. If more than $1.5\times10^{-1}$ mol/l of chloride ion is present, development tends to be retarded, which is unfavorable for accomplishing the object of the present invention of achieving rapid processing and obtaining a high maximum density. A chloride ion concentration less than $3.5\times10^{-2}$ mol/l is disadvantageous from the standpoint of fog prevention.

Also, the color developing solution to be used in the present invention preferably contains from $3.0\times10^{-5}$ to $1.0\times10^{-3}$ mol/l, and particularly from $5.0\times10^{-5}$ to $5\times10^{-4}$ mol/l, of bromide ion. If the amount of bromide ion exceeds $1\times10^{-3}$ mol/l, development is retarded, and the maximum density and sensitivity are reduced. At a bromide ion concentration less than $3.0\times10^{-5}$ mol/l, fog cannot be sufficiently prevented.

The chloride and bromide ions may be directly added to a developing solution or may be supplied through dissolution from the light-sensitive material during development processing. In the former case, suitable chloride ion sources include sodiumchloride, potassium chloride, ammoniumchloride, lithium chloride, nickel chloride, magnesium chloride, manganese chloride, calcium chloride, and cadmium chloride, with sodium chloride and potassium chloride being preferred. The chloride ion may also be supplied by a fluorescent brightening agent incorporated into the developing solution.

Suitable bromide ion sources include sodium bromide, potassium bromide, ammonium bromide, lithium bromide, calcium bromide, magnesium bromide, manganese bromide, nickel bromide, cadmium bromide, cerium bromide, thallium bromide, with potassium bromide and sodium bromide being preferred.

In the latter case where chloride and bromide ion are dissolved out of the light-sensitive material, they may be supplied either from the emulsions or other layers of the photographic material.

The color developing solution which can be used in the present invention preferably has a pH between 9 and 12, and more preferably between 9 and 11.0.

The color developing solution may contain various known additives.

For example, various buffering agents are preferably used to maintain the above-described pH range. Examples of suitable buffering agents include carbonates, phosphates, borates, tetraborates, hydroxybenzoic acid salts, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishydroxyaminomethane salts, and lysine salts. In particular, carbonates, phosphates, tetraborates, and hydroxybenzoates are preferably used because they have excellent solubility and buffering ability in the high pH range of 9.0 or more, do not adversely influence on the photographic performance (e.g., fog) when present in the color developing solution, and are inexpensive.

Specific but non-limiting examples of these buffering agents are sodium carbonate, potassium carbonate, sodium bicarbonate, potassium bicarbonate, sodium tertiary phosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The buffering agent is preferably present in the color developing solution in an amount of 0.1 mol/l or more, and more preferably from 0.1 to 0.4 mol/l.

Various chelating agents can be used in the color developing solution to prevent precipitation of calcium or magnesium or to improve the stability of the developing solution. Examples of suitable chelating agents which can be used include nitrilotriacetic acid, diethylenetriaminepentaacetic acid, ethylenediaminetetraacetic acid, N,N,N-trimethylenephosphonic acid, ethylenediamine-N,N,N', N'-tetramethylenesulfonic acid, transcyclohexanediaminetetraacetic acid, 1,2-diaminopropanetetraacetic acid, glycol ether diaminetetraacetic acid, ethylenediamine o-hydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid. These chelating agents may be used either individually or as a combination of two or more thereof.

The chelating agent is present in an amount sufficient for sequestering metallic ions in a color developing solution, usually in an amount of from about 0.1 g to about 10 g per liter.

If desired, a development accelerator may be added to a color developing solution. Examples of suitable development accelerators include thioether compounds as described in JP-B-37-16088, JP-B-37-5987, JP-B-38-7826, JP-B-44-12380, JP-B-45-9019, and U.S. Pat. No. 3,813,247; p-phenylenediamine compounds as described in JP-A-52-49829 and JP-A-50-15554; quaternary ammonium salts as described in JP-A-50-137726, JP-B-44-30074, JP-A-56-156826, and JP-A-52-43429; amine compounds as described in U.S. Pat. Nos. 2,494,903, 3,128,182, 4,230,796, and 3,253,919, JP-B-41-11431, and U.S. Pat. Nos. 2,482,546, 2,596,926, and 3,582,346; polyalkylene oxides as described in JP-B-37-16088, JP-B-42-25201, U.S. Pat. No. 3,128,183, JP-B-41-11431, JP-B-42-23883, and U.S. Pat. No. 3,532,501; 1-phenyl-3-pyrazolidones; and imidazoles.

If desired, an antifoggant may also be used in the color developing solution. Examples of suitable antifoggants include alkali metal halides, e.g., sodium chloride, potassium bromide and potassium iodide; and organic antifoggants. Typical examples of the organic antifoggants are nitrogen-containing heterocyclic compounds, e.g., benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, and adenine.

The color developing solution preferably contains a fluorescent brightening agent. Examples of suitable fluorescent brightening agents include 4,4'-diamino-2,2'-disulfostilbene compounds. The fluorescent brightening agent is present in an amount of up to 5 g/l, and preferably from 0.1 to 4 g/l.

If desired, various surface active agents, such as alkylsulfonic acids, arylsulfonic acids, aliphatic carboxylic acids, and aromatic carboxylic acids, may also be present in the color developing solution.

Development processing with the above-described color developing solution is carried out at a processing temperature usually ranging from 20° to 50° C., and preferably from 30° to 40° C., for a processing time within 20 seconds, and preferably within 15 seconds. The rate of replenishment is preferably as small as possible and suitably ranges from 20 to 600 ml/m$^2$, preferably from 30 to 300 ml/m$^2$, more preferably from 40 to 200 ml/m$^2$ and most preferably from 60 to 150 ml/m$^2$, of photographic material processed.

The de-silvering process which is carried out in this invention is described below. The de-silvering process is generally comprises, for example, a bleaching process and a fixing process; a fixing process and a bleach-fixing process; a bleaching process and a bleach-fixing process; or a bleach-fixing process.

Bleach baths, bleach-fix baths and fixing baths which can be used in this invention are described below.

Any bleaching agent can be used as the bleaching agent which is used in the bleach bath or bleach-fix bath, but organic complex salts of iron(III) (for example complex salts with amino-polycarboxylic acids, such as ethylenediamine tetraacetic acid and diethylenetriamine penta-acetic acid, aminopolyphosphonic acids, phosphonocarboxylic acids and organic phosphonic acids); or organic acids (such as citric acid, tartaric acid, or malic acid); persulfates; and hydrogen peroxide are preferred.

Of these, the organic complex salts of iron(III) are preferred from the viewpoints of rapid processing and the prevention of environmental pollution. Examples of the aminopolycarboxylic acids, amino-polyphosphonic acids and organic phosphonic acids or the salts thereof which are useful for forming organic complex salts of iron(III) include ethylenediamine tetra-acetic acid, diethylenetriamine pentaacetic acid, 1,3-diaminopropane tetra-acetic acid, propylenediamine tetra-acetic acid, nitrilotriacetic acid, cyclohexanediamine tetra-acetic acid, methyliminodiacetic acid, iminodiacetic acid, and glycol ether diamine tetra-acetic acid. These compounds may take the form of sodium, potassium, lithium, or ammonium salts. Of these compounds, the iron(III) complex salts of ethylenediamine tetra-acetic acid, diethylenetriamine penta-acetic acid, cyclohexanediamine tetraacetic acid, 1,3-diaminopropane tetra-acetic acid and methyliminodiacetic acid are preferred from the viewpoint of their high bleaching power.

These ferric ion complex salts may be used in the form of the complex salts; or the ferric ion complex salts can be formed in solution using a ferric salt (for example, ferric sulfate, ferric chloride, ferric nitrate, ferric ammonium sulfate, or ferric phosphate) and a chelating agent (such as an amino-polycarboxylic acid, aminopolyphosphonic acid, or phosphonocarboxylic acid). Furthermore, the chelating agent may be used in excess over the amount required to form the ferric ion complex salt. The aminopolycarboxylic acid iron complex salts are preferred from among the iron complex salts, and the amount added is from 0.01 to 1.0 mol/liter, and preferably from 0.05 to 0.50 mol/liter.

Various compounds can be used as bleaching accelerators in the bleach baths, bleach-fix baths, or bleach-fix pre-baths. For example, the compounds which have a mercapto group or a disulfide bond disclosed in U.S. Pat. No. 3,893,858, German Patent 1,290,812, JP-A-53-95630, and *Research Disclosure*, No. 17129 (July, 1978); the thiourea based compounds disclosed in JP-B-45-8506, JP-A-52-20832, JP-A-53-32735 and U.S. Pat. No. 3,706,561; or halides, such as iodine or bromine ions, are preferred in view of their excellent bleaching power.

Re-halogenating agents, such as bromides (for example potassium bromide, sodium bromide, ammonium bromide); chlorides (for example potassium chloride, sodium chloride, ammonium chloride); or iodides (for example ammonium iodide) can also be included in the bleach baths or bleach-fix baths used in this invention. One or more inorganic or organic acids, or the alkali metal or ammonium salts thereof, that have a pH buffering capacity (such as borax, sodium metaborate, acetic acid, sodium acetate, sodium carbonate, potassium carbonate, phosphorous acid, phosphoric acid, sodium phosphate, citric acid, sodium citrate or tartaric acid) and corrosion inhibitors (such as ammonium nitrate and guanidine) can be added as required.

Known fixing agents, like thiosulfates (such as sodium thiosulfate and ammonium thiosulfate), thiocyanates (such as sodium thiocyanate and ammonium thiocyanate), thioether compounds (such as ethylenebisthioglycolic acid and 3,6-dithia-1,8-octanediol), and water soluble silver halide solvents (such as the thioureas) can be used as fixing agents in the bleach-fix baths and fixing baths, and these compounds can be used individually, or two or more types can be used conjointly.

Special bleach-fix baths consisting of a combination of large quantities of a halide such as potassium iodide and a fixing agent, as disclosed in JP-A-55-155354, can also be used. The use of thiosulfates, and especially ammonium thiosulfate, is preferred in this invention. The amount of fixing agent per liter is preferably within the range of 0.3 to 2 mol, and most desirably within the range of 0.5 to 1.0 mol. The pH range of the bleach-fix bath or fixing bath in this invention is preferably from 3 to 10, and most desirably from 5 to 9.

Furthermore, various fluorescent whiteners, antifoaming agents or surfactants, polyvinylpyrrolidone end organic solvents such as methanol can be included in the bleach-fix baths.

The inclusion of sulfite ion releasing compounds, such as sulfites (for example, sodium sulfite, potassium sulfite, ammonium sulfite), bisulfites (for example, ammonium bisulfite, sodium bisulfite, potassium bisulfite), and metabisulfites (for example, potassium metabisulfite, sodium metabisulfite, ammonium metabisulfite) as preservatives in the bleach-fix baths and fixing baths is desirable. These compounds are preferably used at a concentration, calculated as sulfite ion, of from about 0.02 to 0.50 mol/liter, and most desirably at a concentration, as sulfite ion, of from 0.04 to 0.40 mol/liter.

Sulfites are generally added as the preservative, but ascorbic acid and carbonyl/bisulfite addition compounds or carbonyl compounds, for example, can also be added.

Buffers, fluorescent whiteners, chelating agents, antifoaming agents, and fungicides, can also be added, as required.

A water washing process and/or stabilization process (unless there is a indication to the contrary, stabilization processes are included hereinafter in the term water washing) is generally carried out after the de-silvering process, such as a fixing or bleach-fixing process.

In this invention the water washing water is treated with a reverse osmosis membrane. Cellulose acetate, crosslinked polyamide, polyether, polysulfone, polyacrylic acid and poly(vinylidene carbonate), for example, can be used as the material of the reverse osmosis membrane, but the use of a crosslinked polyamide based composite membrane or a polysulfone based composite membrane is especially desirable in view of the reduced likelihood of a decrease in the amount of water which is being passed through the membrane.

Low pressure reverse osmosis membranes which can be used with liquid feed pressures of from 2 to 15 $kg/cm^2$ are preferred from the viewpoint of the initial cost of the apparatus, reduced running costs, miniaturization, and the prevention of pump noise. The construction of the membrane may be in a form in which a flat membrane is wound into a coil in what is known as a spiral form, and this type is preferred in that any decrease in the amount of water which is passed is small. Actual examples of such low pressure reverse osmosis membranes include SU-200S, SU-210S and SU-220S made by the Toray Co. and DRA-40, DRA-80 and DRA-86 made by the Daicel Chemical Co.

The liquid feed pressure at which these membranes are used is within a range such as that mentioned above, and preferably is from 2 to 10 $kg/cm^2$, and most preferably is from 3 to 7 $kg/cm^2$ in view of the residual coloration preventing effect and preventing fall-off in the amount of permeating water.

The water washing process involves the use of from 1 to 6 tanks and the connection of a plurality of tanks in a multi-stage counter-flow system as disclosed in the aforementioned photographic processing is preferred for economizing on water usage. The use of from 2 to 5 tanks is more preferred and the use of from 2 to 4 tanks is most preferred.

Treatment of the water washing water with a reverse osmosis membrane is preferably carried out in at least the second tank of a multi-stage counter-flow system of this type. In practice, in the case of a two tank system the water in the second tank is treated with the reverse osmosis membrane. In the case of a three tank system the water in the second or third tank is treated with the reverse osmosis membrane or in the case of a four tank system, the water in the third or fourth tank is treated with the reverse osmosis membrane, and the permeated water is returned to the same tank (the tank from which the water was taken for reverse osmosis membrane treatment is referred to hereinafter as the collection tank) or to a water washing tank which is located following the tank. Furthermore, the concentrated liquid which is produced by the reverse osmosis membrane is supplied to a tank which is located before the tank to which the permeated water is returned (referred to hereinafter as the supply pre-tank).

When the replenish rate is not more than 100 $ml/m^2$, it is preferred to use 4 or 5 tanks for the water washing process and treat the pre-tank to the final tank with a reverse osmosis membrane.

The amount of permeating water supply required is determined by the quality of the permeating water (the removal efficiency of the reverse osmosis membrane), the amount of photographic material being processed in the automatic processor, the carry-over of liquid from the preceding tank by the photographic material and the rate at which fresh water is being supplied, but generally it is within the range of from 1 to 100 times the fresh water supply rate. When the supply rate (replenishment rate) is low, the amount of permeated water supply required is preferably from 5 to 55 times, and most desirably from 10 to 30 times, the fresh water supply rate.

This is described in detail below with reference to FIGS. 1 and 2.

Figure 2:
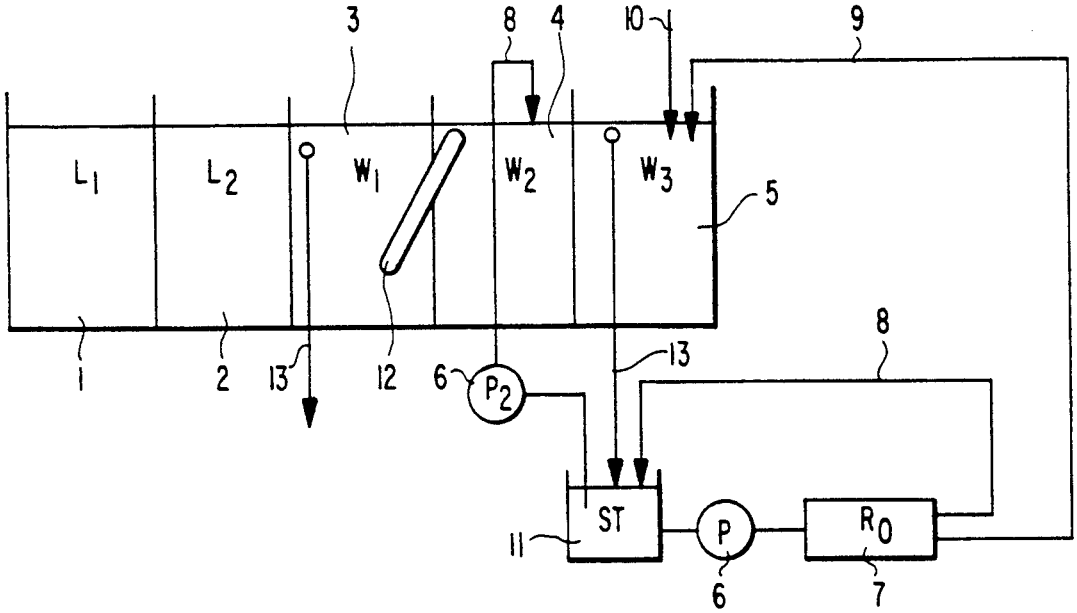

The symbols in FIGS. 1 and 2 have the significance as previously indicated in the BRIEF EXPLANATION OF THE DRAWINGS, above.

FIG. 1 shows a system in which, in a three-tank counter-flow water washing system, washing water is collected from the second water washing tank, subjected to a reverse osmosis treatment and the permeated water D supplied to third water washing tank and the concentrate C returned to the second water washing tank. With this system the pipe work is simple and there is a further advantage in that the procedure can be carried out at low cost. The pressure resistant vessel is made of metal or plastic and the reverse osmosis membrane is housed inside this vessel. The use of glass fibre reinforced plastic is preferred for the material of the pressure resistant vessel from the viewpoints of both corrosion resistance and pressure resistance. Such a method of installing a reverse osmosis membrane can also be applied desirably to cases where there are four or more tanks. Furthermore, the amount of fresh water replenishment required is greatly reduced by the reverse osmosis membrane treatment and the overflow from the first water washing tank is also reduced proportionately and so all of this overflow can be introduced into the bleach-fix tank $L_2$.

FIG. 2 shows a system in which water collected from the third water washing tank $W_3$ is introduced into the first stock tank and then treated with the reverse osmosis membrane. The permeated water D is supplied to the third water washing tank and the concentrate $C_1$ returned to the stock tank.

The overflow from the third water washing tank which produced by replenishment with fresh water is all introduced into the stock tank and water washing water is supplied to the second water washing tank via the stock tank by means of the pump $P_2$. The pumps $P_1$ and $P_2$ are controlled by floating switches in the stock tank. By using a stock tank in this way it is possible to treat the water in the final water washing tank with a reverse osmosis membrane and, since it is possible to subject water which has a lower concentration than in the case shown in FIG. 1, the permeated water has a higher purity and it is possible to maintain the final water wash in cleaner condition.

However, there is some complication in that a stock tank is required, and the methods shown in FIG. 1 and FIG. 2 are selected appropriately with respect to the intended effect and the cost balance.

Methods of this type in which a stock tank is used can also be employed effectively in cases where there are two tanks and in cases where there are four or more tanks.

In this invention the fresh water which is supplied to the water washing tanks may be tap water or well water as generally used for the water washing tank, but the use of water in which the calcium and magnesium contents have been reduced to not more than 3 mg/liter in each case is preferred for preventing completely the formation of bacteria in the first supply tank and for prolonging the life of the reverse osmosis membrane. In practice, the use of water which has been subjected to a de-ionizing treatment by means of an ion exchange resin or distillation is preferred.

The addition of biocides, chelating agents, pH buffers and fluorescent whiteners, for example, to the water washing water is known, and these materials can be used optionally as required. It is desirable that these additives should not be used in large amounts which would tend to increase the load on the reverse osmosis membrane. Thus, this invention has the advantage of enabling satisfactory water economies to be made without using the additive such as biocides that have been required in the past.

In cases where bacteria do form in the storage tank for the fresh water supply, the storage tank is preferably irradiated with ultraviolet light.

The amount of wash water used in a washing process can be fixed within a wide range, depending on the characteristics (such as the materials such as couplers which have been used) and the application of the photographic material, the washing water temperature, the number of water washing tanks (the number of water washing stages), the replenishment system, i.e. whether a counter-flow or sequential flow system is used, and various other factors. The relationship between the amount of water used and the number of washing tanks in a multi-stage counter-flow system can be obtained using the method outlined on pages 248–253 of the *Journal of the Society of Motion Picture and Television Engineers*, Vol. 64 (May, 1955). The number of stages in a normal multi-stage counter-current system is preferably from 2 to 6, and most desirably from 2 to 4.

The amount of wash water can be greatly reduced by using a multi-stage counter-flow system, and washing can be achieved with less than from 0.5 to 1 liter of water per square meter of photographic material, for example, and the effect of the invention is pronounced. However, bacteria proliferate due to the increased residence time of the water in the tanks and problems arise from the suspended matter produced that becomes attached to the photographic material. The method in which the calcium ion and magnesium ion concentrations are reduced, as disclosed in JP-A-62-288838, can be used very effective as a means of overcoming these problems. Furthermore, the isothiazolone compounds and thiabendazoles disclosed in JP-A-57-8542; the chlorine based disinfectants such as chlorinated sodium isocyanurate disclosed in JP-A-61-120145; the benzotriazole disclosed in JP-A-61-267761; copper ions, and the disinfectants disclosed in "*Bokin Bobai no Kagaku* (*The Chemistry of Biocides and Fungicides*)" by Horiguchi (1986), in "*Biseibutsu no Mekkin, Sakkin, Bobai Gijutsu* (*Killing Micro-organisms, Biocidal and Fungicidal Techniques*)" published by the Health and Hygiene Technical Society (1982), and in "*Bokin Bobai-zai Jiten* (*A Dictionary of Biocides and Fungicides*)" published by the Japanese Biocide and Fungicide Society (1986) can also be used to overcome these problems.

Moreover, surfactants can be used as draining agents and chelating agents (such as EDTA) can be used as hard water softening agents in the water washing water.

A direct stabilization process can be carried out following, or in place of, the above mentioned water washing process. Compounds which have an image stabilizing function can be added to the stabilizing bath, and aldehydes (formaldehyde for example), buffers for adjusting the film pH to a level suitable for providing dye stability, and ammonium compounds can be added to the stabilizer. Furthermore, the aforementioned biocides and fungicides can be used to prevent the proliferation of bacteria in the bath and to provide the processed photographic material with biocidal properties.

Moreover, surfactants, fluorescent whiteners and film hardening agents can also be added.

The inclusion of chelating agents in the water washing processing baths of this invention is desirable.

Useful chelating agents can be selected from among the aminopolycarboxylic, aminopolyphosphonic, phosphonocarboxylic alkylidenediphosphonic, metaphosphoric, pyrophosphoric, and polyphosphoric acids for example. Actual examples of chelating agents are indicated below, but the invention is not limited by these examples.

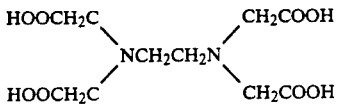
K-1

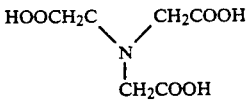
K-2

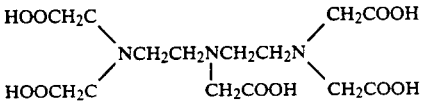
K-3

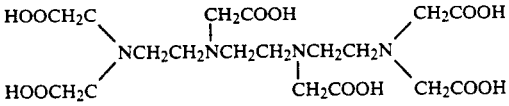
K-4

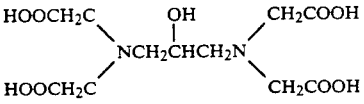
K-5

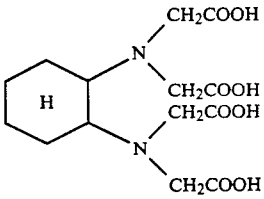
K-6

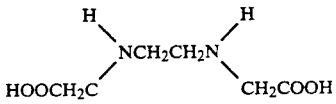
K-7

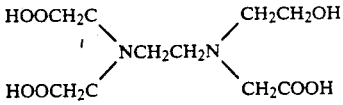
K-8

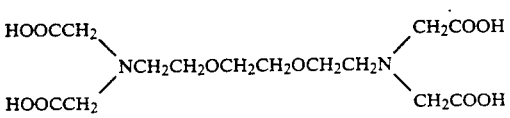
K-9

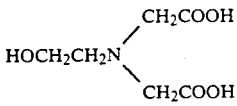
K-10

-continued

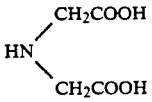
K-11

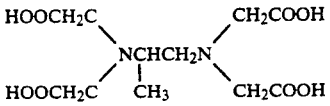
K-12

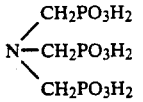
K-13

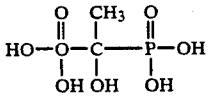
K-14

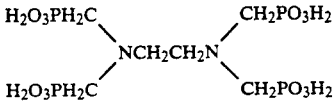
K-15

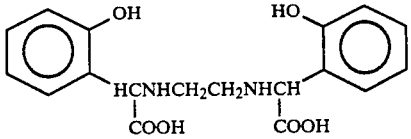
K-16

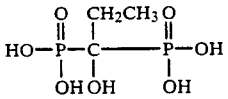
K-17

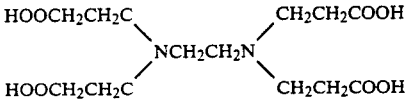
K-18

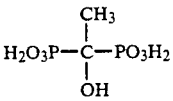
K-19

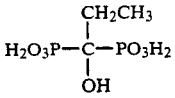
K-20

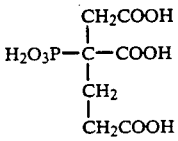
K-21

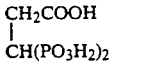
K-22

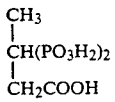
K-23

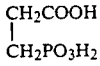
K-24

-continued

K-25

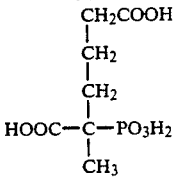

K-26

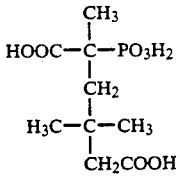

K-27

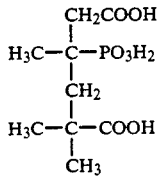

K-28

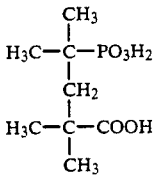

K-29

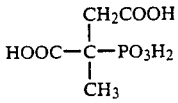

K-30

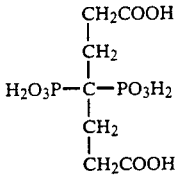

K-31

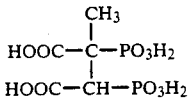

K-32

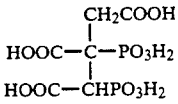

K-33

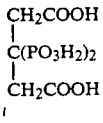

K-34

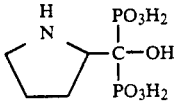

K-35

The alkylidenediphosphonic acids are especially effective among the chelating agents indicated above. The amount of chelating agent added is preferably from 1 to 100 grams, and most desirably from 5 to 50 grams, per liter of water washing bath.

The preferred pH in the water washing or stabilization process is from 4 to 10, and a pH of from 5 to 8 is most desirable. The temperature can be set according to the application and characteristics of the photographic material, but in general the temperature is from 30° C. to 45° C., and preferably from 35° C. to 42° C. The time can be set arbitrarily, but a shorter time is desirable from the viewpoint of reducing the processing time. The time is preferably from 10 seconds to 45 seconds, and most desirably from 10 seconds to 35 seconds. A lower replenishment rate is preferred from the viewpoint of running costs, the amount of effluent, and handleability, for example.

The replenishment rate preferred in practice is from 0.5 to 50 times, and preferably from 2 to 15 times, the carry over from the previous bath per unit area of photographic material. It is not more than 300 ml, and preferably not more than 150 ml, per square meter of photographic material. Furthermore, replenishment can be carried out continuously or intermittently.

The liquid which has been used in the water washing and/or stabilization process can also be used in an earlier process. For example, the amount of washing water is reduced using a multi-stage counter-flow system and the overflow can be introduced into the preceding bleach-fix bath, a concentrate can be added to the bleach-fix bath and the amount of waste liquid can be reduced in this way.

The drying process which can be used in this invention is described below.

A drying time of from 20 seconds to 40 seconds is desirable for completing the image in the ultra-rapid processing of this invention.

Means of shortening the drying time include providing an improvement by reducing the carry over of water in the film by reducing the amount of hydrophilic binder such as gelatin for example, on the light-sensitive material side. Drying can be speeded up by absorbing the water with a cloth or using a squeeze roller immediately after the film emerges from the water washing tank in order to reduce the amount of liquid carry over. Improvements in the drier are also proper, and rapid drying can be achieved by raising the temperature or by using a stronger drying draught. Moreover, drying can be speeded up by adjusting the angle of incidence of the drying draught on the light-sensitive material and by removing the exhausted draught.

The invention is described in practical terms below by means of examples, but the invention is not limited by these examples. Unless otherwise indicated, all percentages and ratios are by weight.

EXAMPLE 1

A multi-layer color printing paper the layer structure of which is indicated below was prepared on a paper support that had been laminated on both sides with polyethylene.

Preparation of the First Layer Coating Liquid.

Ethyl acetate (27.2 cc) and 8.2 grams of solvent (Solv-1) were added to 19.1 gram of yellow coupler (ExY), 4.4 grams of colored image stabilizer (Cpd-1) and 1.4 grams of colored image stabilizer (Cpd-7) to form a solution which was then emulsified and dispersed in 185 cc of a 10% aqueous gelatin solution which contained 8 cc of 10% sodium dodecylbenzenesulfonate. On the other hand, the blue-sensitive sensitizing dyes indicated below were added to a silver chlorobromide emulsion (a 3:7 (Ag mol ratio) mixture of cubic emulsions of average grain size 0.88 μm and 0.70 μm; the variation coefficients of the grain size distributions were 0.08 and 0.10, and each emulsion had 0.2 mol.% of silver bromide included locally on the surface of the grains) in amounts of $2.0\times10^{-4}$ mol of each per tool of silver for the emulsion which had large size grains and in amounts of $2.5\times10^{-4}$ mol of each per mol of silver halide for the emulsion which had small size grains, after which the emulsion was sulfur sensitized. This emulsion was mixed with the aforementioned emulsified dispersion to prepare the first layer coating liquid of which the composition is indicated below.

The coating liquids for the second to the seventh layers were prepared using the same procedure as for the first layer coating liquid. 1-Oxy-3,5-dichloro-s-triazine, sodium salt, was used as a gelatin hardening agent in each layer.

The spectral sensitizing dyes indicated below were used for each layer.

Blue-Sensitive Emulsion Layer

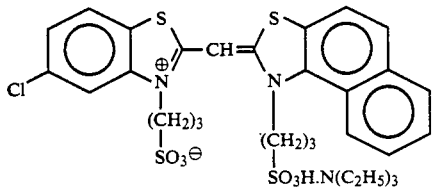

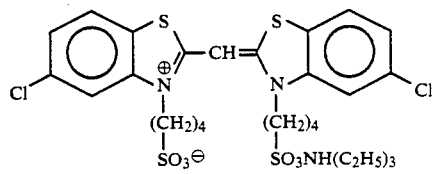

($2.0\times10^{-4}$ mol of each per mol of silver halide for the large size emulsion and $2.5\times10^{-4}$ mol of each per mol of silver halide for the small size emulsion)

Green-Sensitive Emulsion Layer

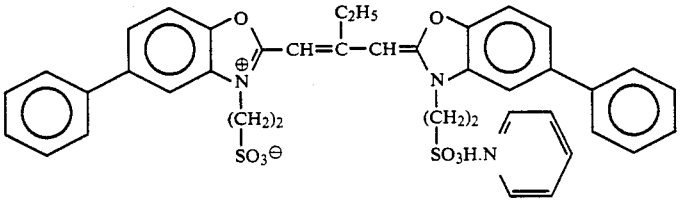

($4.0\times10^{-4}$ mol per mol of silver halide for the large size emulsion and $5.6\times10^{-4}$ mol per mol of silver halide for the small size emulsion) and

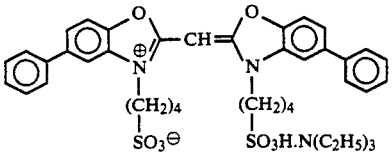

($7.0\times10^{-5}$ mol per mol of silver halide for the large size emulsion and $1.0\times10^{-5}$ mol per mol of silver halide for the small size emulsion)

Red-Sensitive Emulsion Layer

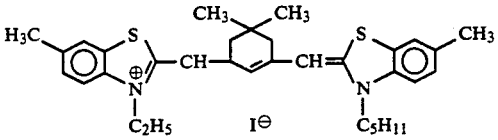

($0.9\times10^{-4}$ mol per mol of silver halide for the large size emulsion and $1.1\times10^{-4}$ mol per mol of silver halide for the small size emulsion)

The compound indicated below was added in an amount of $2.6\times10^{-3}$ mol per mol of silver halide to the red-sensitive emulsion layer.

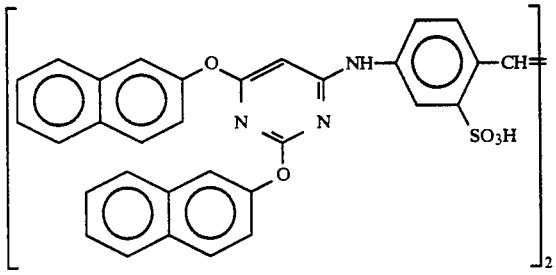

Furthermore, 1-(5-methylureidophenyl)-5-mercaptotetrazole was added to the blue, green, and red sensitive emulsion layers in amounts, per mol of silver halide, of $8.5\times10^{-5}$ mol, $7.7\times10^{-4}$ mol, and $2.5\times10^{-4}$ mol, respectively.

Furthermore, 4-hydroxy-6-methyl-1,3,3a,7-tetraazaindene was added to the blue and green sensitive emulsion layers in amounts, per mol of silver halide, of $1\times10^{-4}$ mol and $2\times10^{-4}$ mol, respectively.

The dyes indicated below were added to the emulsion layers for anti-irradiation purposes.

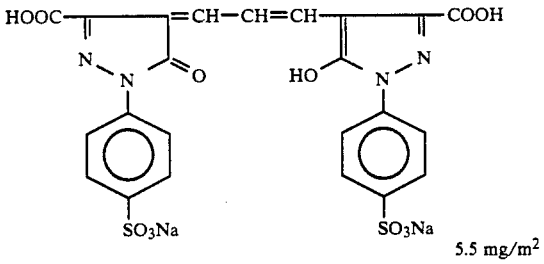

5.5 mg/m² and

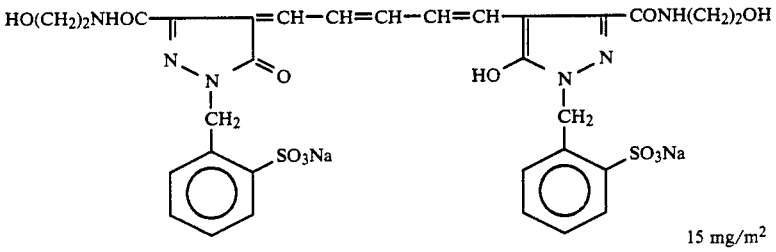

15 mg/m²

Layer Structure

The composition of each layer is indicated below. The numerical values indicate coated weights (g/m²). In the case of silver halide emulsions the coated weight is shown as the calculated coated weight of silver.

Support

Polyethylene Laminated Paper [White pigment ($TiO_2$) and bluish dye (ultramarine) were included in the polyethylene on the first layer side.]

| | |
|---|---|
| First Layer (Blue Sensitive Layer) | |
| The Aforementioned Silver Chlorobromide Emulsion | 0.27 |
| Gelatin | 0.74 |
| Yellow Coupler (ExY) | 0.67 |
| Colored Image Stabilizer (Cpd-1) | 0.19 |
| Solvent (Solv-1) | 0.35 |
| Colored Image Stabilizer (Cpd-7) | 0.06 |
| Second Layer (Anti-Color Mixing Layer) | |
| Gelatin | 0.75 |
| Anti-Color Mixing Agent (Cpd-5) | 0.08 |
| Solvent (Solv-1) | 0.16 |
| Solvent (Solv-4) | 0.08 |
| Third Layer (Green Sensitive Layer) | |
| Silver Chlorobromide Emulsion (A 1:3 (silver mol ratio) mixture of cubic emulsions of average grain size 0.55 μm and 0.39 μm; the variation coefficients of the grain size distributions were 0.10 and 0.08, and each emulsion had 0.8 mol · % AgBr included locally on the grain surfaces.) | 0.12 |
| Gelatin | 0.66 |
| Magenta Coupler (ExM) | 0.26 |
| Colored Image Stabilizer (Cpd-2) | 0.03 |
| Colored Image Stabilizer (Cpd-3) | 0.15 |
| Colored Image Stabilizer (Cpd-4) | 0.02 |
| Colored Image Stabilizer (Cpd-9) | 0.02 |
| Solvent (Solv-2) | 0.40 |
| Fourth Layer (Ultraviolet Absorbing Layer) | |
| Gelatin | 0.63 |
| Ultraviolet Absorber (UV-1) | 0.47 |
| Anti-Color Mixing Agent (Cpd-5) | 0.05 |
| Solvent (Solv-5) | 0.24 |
| Fifth Layer (Red Sensitive Layer) | |
| Silver Chlorobromide Emulsion (A 1:4 (silver mol ratio) mixture of a cubic emulsions of average grain size 0.58 μm and 0.45 μm; the variation coefficients of the grain size distributions were 0.09 and 0.11, and each emulsion had 0.6 mol · % AgBr included locally on the grain surfaces.) | 0.20 |
| Gelatin | 1.00 |
| Cyan Coupler (ExC) | 0.32 |
| Colored Image Stabilizer (Cpd-6) | 0.17 |
| Colored Image Stabilizer (Cpd-7) | 0.40 |
| Colored Image Stabilizer (Cpd-8) | 0.04 |
| Solvent (Solv-6) | 0.15 |
| Sixth Layer (Ultraviolet Absorbing Layer) | |
| Gelatin | 0.48 |
| Ultraviolet Absorber (UV-1) | 0.16 |

-continued
| | |
|---|---|
| Anti-Color Mixing Agent (Cpd-5) | 0.02 |
| Solvent (Solv-5) | 0.08 |
| Seventh Layer (Protective Layer) | |
| Gelatin | 1.26 |
| Acrylic Modified Poly(vinyl alcohol) (17% modification) | 0.17 |
| Liquid Paraffin | 0.03 |
(ExY) Yellow Coupler
A 1:1 (mol ratio) mixture of:
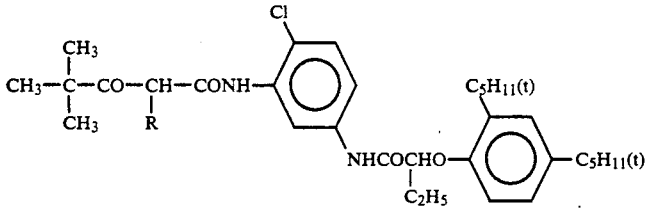
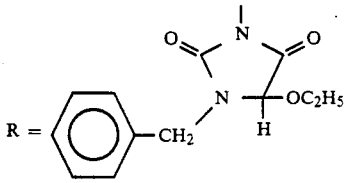
and
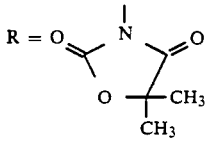
(ExM) Magenta Coupler
A 1:1 (mol ratio) mixture of
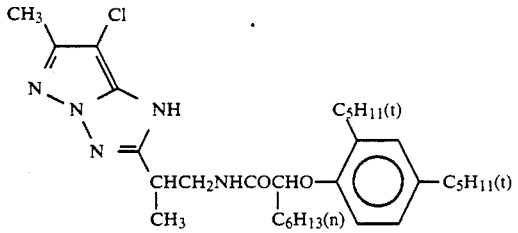
and
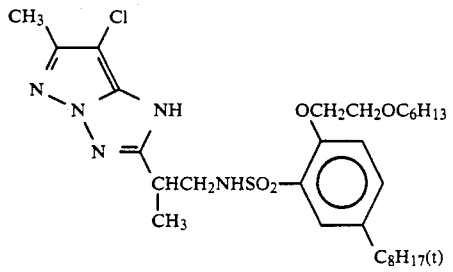
(ExC) Cyan Coupler
A 2:4:4 (by weight) mixture of:
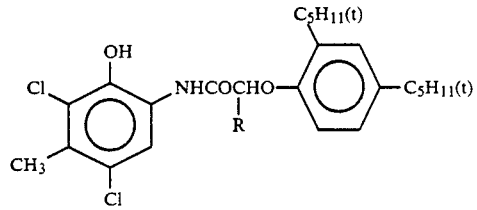

-continued
R = $C_2H_5$ and $C_4H_9$
and
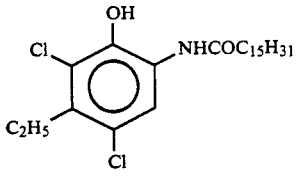
(Cpd-1) Colored Image Stabilizer
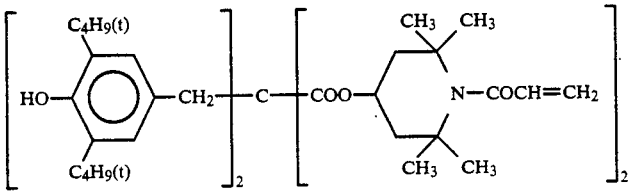
(Cpd-2) Colored Image Stabilizer
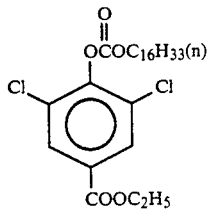
(Cpd-3) Colored Image Stabilizer
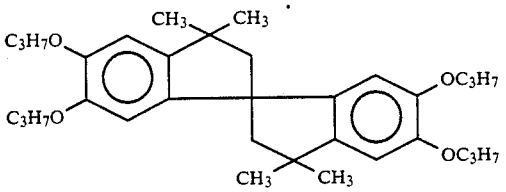
(Cpd-4) Colored Image Stabilizer
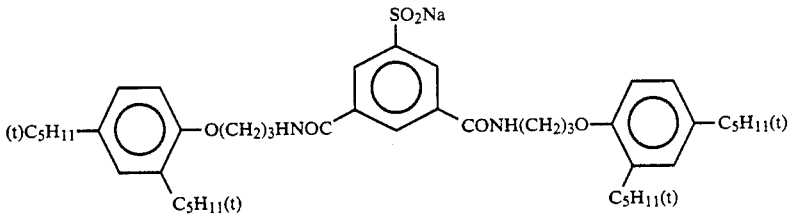
(Cpd-5) Anti-color Mixing Agent
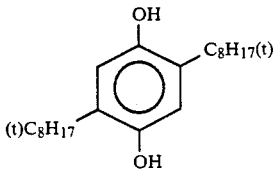
(Cpd-6) Colored Image Stabilizer
A 2:4:4 (by weight) mixture of:

-continued
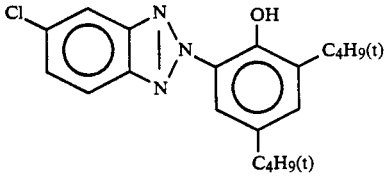
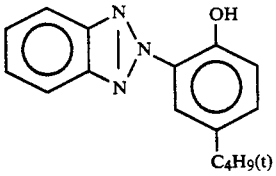
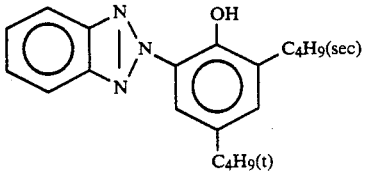
(Cpd-7) Colored Image Stabilizer
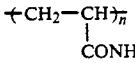
Average Molecular Weight 60,000
(Cpd-8) Colored Image Stabilizer
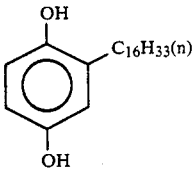
(Cpd-9) Colored Image Stabilizer
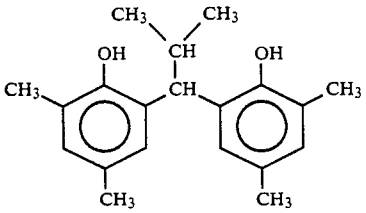
(UV-1) Ultraviolet Absorber
A 4:2:4 (by weight) mixture of:
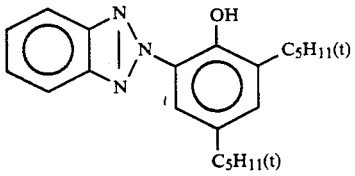
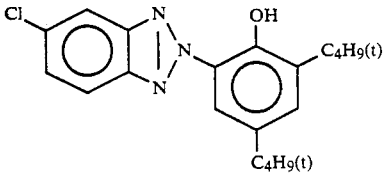

-continued

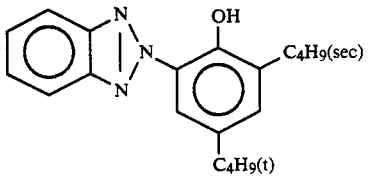

(Solv-1) Solvent

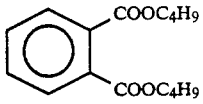

(Solv-2) Solvent
A 2:1 (by volume) mixture of:

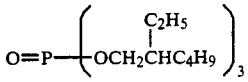

and

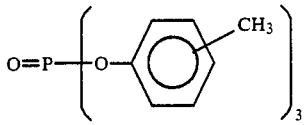

(Solv-4) Solvent

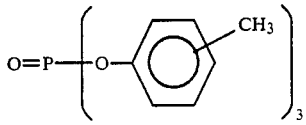

(Solv-5) Solvent

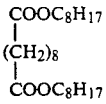

(Solv-6) Solvent

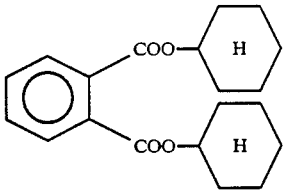

The sample prepared in this way was sample 101. The "alkali consumption" of sample 101 was 2.6 mmol/m$^2$.

The sample was subjected to a graded exposure with sensitometric tri-color separation filters using a sensitometer (model FWH made by Fuji Photo Film Co., Ltd., light source color temperature 3200° K.). The exposure at this time was carried out in such a way as to provide an exposure of 250 CMS with an exposure time of 0.1 second.

The exposed sample was processed in the way outlined below using a paper processor in a continuous running test until replenishment had been carried out to twice the capacity of the color development tank. Moreover, the transporting speed of the paper processor which was being used was 1 cm/sec and the photographic material had a width of 21 cm.

| Processing Step | Temperature (°C.) | Time (sec.) | Replenisher* | Tank Capacity |
|---|---|---|---|---|
| Color Development | 40 | 15 | 60 ml | 2 liters |
| Bleach-fix | 40 | 15 | 60 ml | 2 liters |
| Rinse (1) | 40 | 15 | — | 2 liters |
| Rinse (2) | 40 | 15 | — | 2 liters |
| Rinse (3) | 40 | 15 | 60 ml | 2 liters |

-continued

| Processing Step | Temperature (°C.) | Time (sec.) | Replenisher* | Tank Capacity |
|---|---|---|---|---|
| Drying | 70–80 | 20 | | |

and the concentrated water was returned to the second rinse tank.

This process is referred to hereinafter as process (I).

Processes (II) to (VII) were established by modifying parts of process (I) in the way indicated in the following table.

| Process | Replenishment Rate (ml/m²) | <ml/min> | Amount of Permeating Water/ Amount of Replenishment | Liquid Feed Pressure (kg) |
|---|---|---|---|---|
| I | 60 | <7,56> | 19.8 | 4 |
| II | 90 | <11.3> | 13.2 | 4 |
| III | 30 | <3.78> | 39.7 | 4 |
| IV | 180 | <22.6> | 6.6 | 4 |
| V | 60 | <7.56> | 53.0 | 5.5 |
| VI | 60 | <7.56> | 59.5 | 6.5 |
| VII | 30 | <3.78> | 211 | 13 |
| VIII Comp. Ex. | 60 | <7.56 | 0 (No reverse osmosis treatment) | |
| IX Comp. Ex. | 90 | <11.3> | 0 (No reverse osmosis treatment) | |

*Replenishment rate per square meter of photographic material.
(A three tank counter flow system from Rinse (3) → Rinse (1) was used.)

The composition of each processing bath was as indicated below.

| Color Development Bath | Tank Solution | Replenisher |
|---|---|---|
| Water | 800 ml | 800 ml |
| Ethylenediamine-N,N,N,N-tetra-methylenephosphonic acid | 1.5 grams | 2.0 grams |
| Potassium Bromide | 0.015 gram | — |
| Triethanolamine | 8.0 grams | 12.0 grams |
| Sodium Chloride | 1.4 grams | — |
| Potassium Carbonate | 25 grams | 25 grams |
| N-Ethyl-N-(3-hydroxypropyl)-3-methyl-4-aminoaniline di-p-toluenesulfonate | 6.8 grams | 9.5 grams |
| N,N-Bis(carboxymethyl)hydrazine | 5.5 grams | 7.0 grams |
| Fluorescent Whitener (WHITEX 4B, made by Sumitomo Chemical Co.,) | 1.0 gram | 2.0 grams |
| Water to make up to | 1000 ml | 1000 ml |
| pH (25° C.) | 10.05 | 10.45 |
| **Bleach-fix Bath (Tank Solution = Replenisher)** | | |
| Water | | 400 ml |
| Ammonium Thiosulfate (70%) | | 100 ml |
| Sodium sulfite | | 17 grams |
| Ethylenediamine tetra-acetic acid, ferric ammonium salt | | 55 grams |
| Ethylenediamine tetra-acetic acid, di-sodium salt | | 55 grams |
| Ammonium bromide | | 5 grams |
| Water to make up to | | 40 grams |
| pH (25° C.) | | 1000 ml |
| | | 6.0 |
| **Rinse Bath (Tank Solution = Replenisher)** | | |
| Tap water (calcium 23 mg/1, magnesium 3 mg/1, conductivity 170 μs/cm) | | |

A spiral type RO module element DRA-80 (effective film area 1.1 m², polysulfone based composite membrane) made by the Daicel Chemical Co. was used as the reverse osmosis membrane. It was housed in a plastic pressure resistant vessel model PV-0321 made by the same company.

The reverse osmosis membrane was established in the way indicated in FIG. 1 and water from the second rinse tank was fed under pressure to the reverse osmosis membrane using a pump under conditions of liquid feed pressure 4 kg/cm², liquid feed flow rate 1.5 l/min. The permeated water was supplied to the third rinse tank With process VI, the noise was loud during operation. The running noise was insignificant for processes I to IV.

After color development processing, the yellow, magenta and cyan densities were measured using a densitometer and the so-called characteristic curves were obtained.

Moreover, processed light-sensitive materials from the initial and latter stages of the continuous processing run were aged for 8 days at 70° C., 70% and the increase due to ageing in the value density due to ageing of the minimum density part was evaluated as staining.

The results obtained are indicated below.

Results of Staining

| | Process | Continuous Processing At The Start | At The Finish |
|---|---|---|---|
| I | (This Invention) | 0.05 | 0.09 |
| II | (This Invention) | 0.06 | 0.08 |
| III | (This Invention) | 0.06 | 0.10 |
| IV | (This Invention) | 0.06 | 0.06 |
| V | (This Invention) | 0.06 | 0.07 |
| VI | (This Invention) | 0.06 | 0.07 |
| VII | (This Invention) | 0.06 | — |
| VIII | (Comparative Ex.) | 0.06 | 0.27 |
| IX | (Comparative Ex.) | 0.06 | 0.34 |

Moreover, even with the comparative examples the color density was satisfactory and the images were completed even with rapid processing As has been outlined above, the effect of the treatment with a reverse osmosis membrane is clear.

EXAMPLE 2 (Modification of the Alkali Consumption)

Samples 201 and 202 of this invention and comparative sample 20A were prepared by modifying just the parts indicated below in sample 101.

| Sample No. | Layer | Details | | | |
|---|---|---|---|---|---|
| 201 | First | Gelatin | 0.74 | Amount of Coupler Coated | 0.60 |
| | Second | | 0.95 | | |
| | Third | | 0.65 | | 0.20 |
| | Fourth | | 0.82 | | |
| | Fifth | | 1.05 | | 0.26 |
| 202 | First | Gelatin | 0.51 | Amount of Coupler Coated | 0.48 |
| | Third | | 0.50 | | 0.21 |

-continued

| Sample No. | Layer | Details | | | |
|---|---|---|---|---|---|
| | Fifth | | 0.35 | | 0.22 |
| | Sixth | | 0.35 | POLY-1 | 0.16 |
| | Seventh | | 0.38 | | |
| 20A | First | Gelatin | 1.00 | | |
| (Comp. Ex.) | Second | | 1.25 | | |
| | Third | | 1.10 | | |
| | Fourth | | 1.42 | | |

POLY-1: Polyacrylamide (average molecular weight about 100,000

The alkali consumption of sample 201 was 2.8 mmol/m$^2$, that of sample 202 was 2.2 mmol/m$^2$ and that of sample 20A was 3.1 mmol/m$^2$.

These samples were processed in the same way as in process (I) in Example 1 and the results of staining evaluated using the same method as described in Example 1 are indicated below.

| Process | Continuous Processing | |
|---|---|---|
| | At The Start | At The Finish |
| 101 (This Invention) | 0.05 | 0.09 |
| 201 (This Invention) | 0.06 | 0.10 |
| 202 (This Invention) | 0.05 | 0.07 |
| 20A (Comparative Ex.) | 0.06 | 0.12 |

It is clear that better results were obtained with light-sensitive materials which had a small alkali consumption.

EXAMPLE 3

Processing was carried out using processing steps in which just the parts indicated below of process (I) in Example 1 had been modified.

| Modified Part | | Details |
|---|---|---|
| I-21 | Rinse Bath | PK-1 (see below) 9.0 grams<br>$H_2O$ 991 ml<br>Adjusted to pH 6.5 with NaOH |
| I-22 | Rinse Bath | PK-2 (see below) 7.1 grams<br>$H_2O$ 992.9 ml<br>Adjusted to pH 6.5 with NaOH |
| I-23 | Rinse Bath | PK-3 (see below) 6.2 grams<br>$H_2O$ 993.8 ml<br>Adjusted to pH 6.5 with NaOH |

PK-1

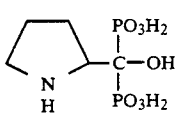

PK-2

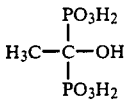

PK-3 $H_2O_3POPO_2H_2$

The results with respect to staining evaluated in the same way as in Example 1 were as shown in the following table.

| Process | Continuous Processing | |
|---|---|---|
| | At The Start | At The Finish |
| I (Example 1) | 0.05 | 0.09 |
| I-21 | 0.05 | 0.07 |
| I-22 | 0.05 | 0.07 |
| I-23 | 0.05 | 0.07 |

It is clear that the effect was increased by the inclusion of a chelating agent in the rinse bath.

EFFECT OF THE INVENTION

By means of this invention it is possible to attain satisfactory photographic performance even when the water washing time is shortened and especially when overall ultra-rapid processing from color development to drying is carried out. In addition, this invention is especially effective for preventing the occurrence of staining.

Such results can also be realized satisfactorily when the replenishment rate of the water washing water and/or stabilizer is reduced.

Moreover, by carrying out treatment with a reverse osmosis membrane at a pressure of not more than 10 kg/cm$^2$ it is possible to reduce the cost of the apparatus and to reduce the noise level, and the invention can be used in intelligent hard copy applications.

While the invention has been described in detail and with reference to specific embodiments thereof, it will be apparent to one skilled in the art that various changes and modifications can be made to the invention without departing from its spirit and scope.

What is claimed is:

1. A method of processing a silver halide color photographic material comprising the steps of:

(1) developing in a color developing bath an imagewise exposed silver halide color photographic material containing a hydrophilic colloid in a total amount of from 3.5 to 6.0 g/m$^2$ and having an alkali consumption of from 2.2 mmol/m$^2$ to 3.0 mmol/m$^2$, said silver halide color photographic material comprising (a) a support;

(b) two or three silver halide emulsion layers on at least one side of said support, said two or three silver halide emulsion layers each containing (i) silver halide emulsions being sensitive to different wavelength bands from one another, said silver halide emulsions containing at least 90 mol % silver chloride, and (ii) oil soluble couplers that form dyes on coupling with oxidized primary amine color developing agent in an amount of 0.1 to 1.0 mol per mol of silver halide contained in the same layer; and (2) washing in a water washing bath said developed color photographic material for 10 to 45 seconds where water from said washing step is treated with reverse osmosis membrane and reused in said washing step, wherein alkali consumption is the amount of potassium hydroxide, in mmol units, needed to change the pH of a liquid containing the coated layers of a 1 m$^2$ portion of the photographic material dispersed in 100 ml of water from 6.0 to 10.0.

2. The method of processing a silver halide color photographic material as claimed in claim 1, wherein said developing step is completed within 20 seconds and the total time for processing up to completion of a drying step is within 100 seconds.

3. The method of processing a silver halide color photographic material as claimed in claim 1, wherein water used in said washing step is replenished at a rate of 150 ml/m$^2$ or less of photographic material; and the ratio of $$\frac{\text{water permeating through the reverse osmosis membrane per unit of time}}{\text{water washing water replenishment rate per unit of time}}$$

is from 5 to 55.

4. The method of processing a silver halide color photographic material as claimed in claim 1, wherein water used in said washing step is replenished at a rate of 60 ml/m$^2$ or less of photographic material; and the ratio of $$\frac{\text{water permeating through the reverse osmosis membrane per unit of time}}{\text{water washing water replenishment rate per unit of time}}$$

is from 10 to 30.

5. The method of processing a silver halide color photographic material as claimed in claim 1, wherein said silver halide color photographic material is essentially silver iodide free silver chlorobromide or silver chloride.

6. The method of processing a silver halide color photographic material as claimed in claim 1, wherein the average grain size of the silver halide grains in said silver halide emulsions is from 0.1 to 2 μm.

7. The method of processing a silver halide color photographic material as claimed in claim 1, wherein the reverse osmosis membrane is a crosslinked polyamide based composite membrane or a polysulfone based composite membrane.

8. The method of processing a silver halide color photographic material as claimed in claim 1 wherein a chelating agent is used in the washing step in an amount of from 1 to 100 grams per liter of water washing bath.

9. The method of processing a silver halide color photographic material as claimed in claim 1, wherein the time for washing said color photographic material is from 10 seconds to 35 seconds.

10. The method of processing a silver halide color photographic material as claimed in claim 1, wherein the developing step is carried out for 15–20 seconds.

11. A method of processing a silver halide color photographic material comprising the steps of:

(1) developing in a color developing bath an imagewise exposed silver halide color photographic material containing a hydrophilic colloid in a total amount of from 3.5 to 6.0 g/m$^2$ and having an alkali consumption of from 2.2 mmol/m$^2$ to 3.0 mmol/m$^2$, the developing step is carried out for 15–20 seconds, said silver halide color photographic material comprising (a) a support;

(b) two or three silver halide emulsion layers on at least one side of said support, said two or three silver halide emulsion layers each containing (i) silver halide emulsions being sensitive to different wavelength bands from one another, said silver halide emulsions containing at least 90 mol % silver chloride, and (ii) oil soluble couplers that form dyes on coupling with oxidized primary amine color developing agent in an amount of 0.1 to 1.0 mol per mol of silver halide contained in the same layer, and (2) washing in a water washing bath said developed color photographic material for 10 to 45 seconds where water from said washing step is treated with a reverse osmosis membrane and reused in said washing step, wherein alkali consumption is the amount of potassium hydroxide, in mmol units, needed to change the pH of a liquid containing the coated layers of a 1 m$^2$ portion of the photographic material dispersed in 100 ml of water from 6.0 to 10.0.

* * * * *